US006761012B2

(12) United States Patent
Rusert et al.

(10) Patent No.: US 6,761,012 B2
(45) Date of Patent: Jul. 13, 2004

(54) PRE-PREPARED MESH-FILM WEB FOR USE ON FORM, FILL AND SEAL MACHINES

(75) Inventors: Craig R. Rusert, Dunwoody, GA (US); Warren H. Debnam, Hanover, PA (US)

(73) Assignee: Atlanta Nisseki CLAF, Inc., Kennesaw, GA (US)

( * ) Notice: Subject to any disclaimer, the term of this patent is extended or adjusted under 35 U.S.C. 154(b) by 0 days.

(21) Appl. No.: 10/321,981

(22) Filed: Dec. 17, 2002

(65) Prior Publication Data

US 2003/0131563 A1 Jul. 17, 2003

Related U.S. Application Data

(60) Provisional application No. 60/341,531, filed on Dec. 18, 2001.

(51) Int. Cl.[7] ..... B65B 9/20

(52) U.S. Cl. ..... 53/410; 53/389.2; 53/451

(58) Field of Search ..... 53/410, 451, 389.2; 156/544; 206/439, 484.1; 383/117; 442/38, 50, 58

(56) References Cited

U.S. PATENT DOCUMENTS

| | | | | |
|---|---|---|---|---|
| 1,351,809 A | * | 9/1920 | Jutherland | 53/136.2 |
| 2,687,764 A | | 8/1954 | Hauser | |
| 2,893,189 A | * | 7/1959 | Lancaster | 53/389.2 |
| 3,257,915 A | | 6/1966 | Etal | |
| 3,554,368 A | | 1/1971 | Nagel | |
| 3,716,434 A | * | 2/1973 | Cook et al. | 156/157 |
| 3,996,721 A | | 12/1976 | Mercer | |
| 4,207,983 A | | 6/1980 | Wolske | |
| 4,282,055 A | | 8/1981 | Bosse et al. | |
| 4,288,965 A | | 9/1981 | James | |
| 4,291,082 A | | 9/1981 | Stall | |
| 4,322,929 A | | 4/1982 | Nuemann | |
| 4,348,445 A | * | 9/1982 | Craig | 428/138 |
| 4,355,494 A | | 10/1982 | Tilman | |
| 4,403,637 A | | 9/1983 | Rivelles Sabater et al. | |
| 4,532,754 A | | 8/1985 | Hokanson | |
| 4,554,202 A | | 11/1985 | Kamei et al. | |
| 4,563,231 A | | 1/1986 | Porrmann et al. | |
| 4,617,683 A | | 10/1986 | Christoff | |
| 4,753,538 A | * | 6/1988 | Jorda | 383/117 |
| 4,881,933 A | | 11/1989 | Wech | |
| 4,883,450 A | | 11/1989 | Benoit | |
| 4,889,523 A | | 12/1989 | Sengewald | |
| 4,931,126 A | * | 6/1990 | McCarville et al. | 156/544 |
| 4,974,968 A | | 12/1990 | Mandus et al. | |
| 4,988,213 A | | 1/1991 | Mattle | |
| 5,117,612 A | | 6/1992 | Keim et al. | |
| 5,294,148 A | | 3/1994 | Imai | |
| 5,369,936 A | | 12/1994 | Callahan et al. | |
| 5,401,101 A | | 3/1995 | Wang | |
| 5,417,638 A | | 5/1995 | Anderson et al. | |
| 5,529,659 A | | 6/1996 | Ellsworth et al. | |
| 5,552,165 A | | 9/1996 | Haak et al. | |
| 5,571,361 A | | 11/1996 | Stuerzel | |
| 5,729,961 A | | 3/1998 | Dauder-Guardiola | |
| 5,741,076 A | | 4/1998 | Cammack | |
| 5,823,683 A | | 10/1998 | Antonacci et al. | |
| 5,912,197 A | | 6/1999 | Madderom | |
| 6,024,489 A | | 2/2000 | Fox et al. | |
| 6,030,120 A | | 2/2000 | Fox et al. | |
| 6,080,093 A | * | 6/2000 | Henderson et al. | 493/187 |
| 6,185,908 B1 | | 2/2001 | Madderom | |
| 6,190,044 B1 | | 2/2001 | Fox et al. | |
| 6,506,429 B1 | * | 1/2003 | Recchia, Jr. | 383/117 |

FOREIGN PATENT DOCUMENTS

| | | |
|---|---|---|
| EP | 0 677 450 A1 | 10/1995 |
| EP | 0 788 974 A3 | 8/1997 |

* cited by examiner

*Primary Examiner*—John Sipos
(74) *Attorney, Agent, or Firm*—Myers & Kaplan, LLC; Barry E. Kaplan; Ashish D. Patel

(57) ABSTRACT

A pre-prepared mesh-film web is used on a conventional vertical form-fill-seal packing machine to form a plurality of mesh-film bags.

16 Claims, 19 Drawing Sheets

PRE-PREPARED MESH-FILM WEB FOR USE ON FORM, FILL AND SEAL MACHINES

RELATED APPLICATIONS

The inventors hereof claim priority based upon U.S. provisional patent application serial No. 60/341,531 filed on Dec. 18, 2001.

BACKGROUND OF THE INVENTION

Mesh bags are used to package many different products, for instance, children's toys, small hardware items, flower bulbs, nuts, fruits and vegetables. Plastic bags made with thermal sealable films (both solid and perforated) are also used to package many of these same items. Mesh bags and perforated film bags allow air to flow through the package. Perishable items such as flower bulbs, nuts, fruits, and vegetables are often packaged in mesh or perforated film because they benefit from the airflow.

Vertical form, fill and seal machines are widely used in the packaging industry. They are widely used because they reduce packaging costs, especially labor costs associated with loading or filling premade bags.

Thermoplastic films, both solid and perforated, have been widely used on vertical form, fill, and seal machines for more than 20 years. Mesh materials have generally not been used on vertical form, fill, and seal machines because they are difficult to process on vertical form, fill, and seal equipment.

Typical mesh materials have a significantly higher degree of open air space between strands (openness) than do perforated films. This is true because typical mesh films are composed of thin strands. This is also true because there is a limit to the size and number of perforation holes that can be used before a perforated film loses its tensile strength, tear resistance, and dimensional stability. For example, a typical 10 lb. plastic bag having a length of 18" and a width of 10" for fresh whole potatoes might have 12 holes punched for ventilation approximately 0.375" diameter. This is equivalent to 0.4% is the surface area of the plastic film on both-sides of the bag. Whereas a mesh material such as the preferred CLAF mesh is at least 50% open. The resultant step change in openness for mesh materials significantly increases airflow through the mesh package compared to a perforated film package.

The thin strands of typical mesh materials also reduce the surface area inside the package where moisture and condensation can be trapped and collect. Entrapped moisture and condensation inside the package are generally believed to increase spoilage and/or decrease shelf life for most perishable items, particularly whole potatoes and onions packed fresh or from storage.

The combination of increased airflow through the package is and reduced entrapment of moisture inside the package is desired by most packinghouse operators, distributors, and marketers of perishable fruit and vegetables.

Heretofore, the use of mesh materials on vertical form-fill-seal machines has been limited due to concerns about heat seal failures and overall package integrity. The most common failures are in either (1) the mesh-to-mesh transverse fin seals, and/or (2) the mesh-to-mesh longitudinal lap (or fin) seals. Failures of mesh-to-mesh heat seals are common in the predominant package weights ranging from one pound to ten pounds. In the majority of attempts to use mesh materials on vertical form-fill-seal machines, the package either fails at or adjacent to the transverse fin seal, at or adjacent to the longitudinal lap (or fin) seal, or both. The primary reason for mesh-to-mesh heat seal failures is the lack of an adequate and consistent mass of thermal sealable plastic material in the desired heat seal area.

Although there are distinct advantages to the use of mesh materials for such packages, for many of the above-described reasons, perforated films are typically chosen over mesh for use on vertical form-fill-seal machines when perishable items are being packed.

The grower-shippers and packing facilities that package perishable items have also imposed additional demands for increased packing and filling speeds for pre-made bag filling equipment and automated form-fill-seal packing equipment. In either case, filling premade bags or filling on vertical form, fill, and seal machines, the larger the fill opening for the items to be packed, the greater the filling speed.

Typically, the length of a bag is greater than its width. That being the standard, there is an advantage to filling the bag through the side as opposed to filling through the top. Regardless of the filling method employed (manual, semi-automatic, or fully automatic) the vast majority of all bags are filled through the top of the bag, thus the 10 opening size for placing articles in the bag is limited by the top circumference dimension of the premade bag or vertical form, fill, and seal package. Thusly, the speed of packing is also limited.

Fox U.S. Pat. No. 6,190,044 indicates examples of typical premade bag sizes indicating horizontal (width) and vertical (length) dimensions of the side walls (sides) for various produce weights as follows:

| Produce | | Cross Sectional Area | |
|---|---|---|---|
| Weight | Bag Wall Dimensions | Top Fill | Side Fill |
| 2 pounds | 10" horizontal by 16" vertical | 31.41 square inches | 50.26 square inches |
| 3 pounds | 10.5" horizontal by 16" vertical | 32.98 square inches | 50.26 square inches |
| 5 pounds | 10.5" horizontal by 19" vertical | 32.98 square inches | 59.68 square inches |
| 10 pounds | 13" horizontal by 23" vertical | 40.84 square inches | 72.25 square inches |

Note:
the horizontal dimensions above are the bag tops & bottom and the vertical dimensions above the bag left & right sides It is clear from the cross sectional area that the openings for filling through the sides are significantly greater the openings for filling top. Those skilled in the art of operating packaging equipment would easily recognize the advantages of being able to automatically fill packages with articles through the larger side opening of the package rather than through the smaller top opening of the package.

Grower-shippers and packing facilities that package perishable items have also imposed additional demands on packing equipment manufacturers for reduced equipment cost, increased packing and filling speeds, increased efficiency, increased flexibility, and reduced waste during the packing processes. This is true for packing machines designed and used for packing pre-made bags, as well as for vertical form, fill, and seal 1 packing machines.

In recent years, particularly in Europe, new vertical form, fill, and seal machines designed to run mesh materials have been introduced to the market by Pannekeet Machine Techniek of The Netherlands, Sorma Netpack of Italy, and Affeldt Verpackungsmaschinen GmbH of Germany. For the most part, these are machines that are designed for the primary purpose of running mesh with large labels front and back, the use of labels being advantageous to reinforce the mesh-to-mesh transverse heat seals. The fact that they require large labels, however, adds significant cost to the final package. There is also the burden of added capital investment for the packing house operator if he has to purchase special vertical form, fill and seal machines designed primarily to run mesh material only.

WO9914121 (EP 0 677 450 A1) is directed to the utilization of a mesh web on vertical form, fill, and seal machines made by Pannekeet Machine Techniek of The Netherlands and Affeldt Verpackungsmaschinen GmbH of Germany specifically for improved packaging of perishable items. WO9914121 (EP 0 677 450 A1) provides that the top and bottom mesh-to-mesh heat seals of the vertical form, fill, and seal package are reinforced by positioning a large film label on both the front and back of the package sandwiching a mesh tube in-between. The front and back labels run the full length and nearly the full width of the lay-flat package. Aside from advertising, the primary purpose of the front and back label is to reinforce and prevent the top and bottom heat seals from failing. While this method may reduce heat seal failures typical of most mesh-to-mesh seals, it falls short because its advantages are offset by the following deficiencies:

(1) the bag must be filled through the narrow top opening; thereby, limiting filling speeds;

(2) the finished bag must be gusseted on both sides in order to eliminate any mesh-to-mesh transverse direction fin seals top and bottom that would likely fail in most practical applications over 1.0 lb.;

(3) the front and back label panels dictate the finished bag width;

(4) the finished bag requires very large labels front and back in addition to the tube of mesh material; thereby, increasing the total packaging materials required by as much as 60% to 70% as compared with alternative packages for the same application, for example Fox 6,190,044 81; and, (5) the finished bag cost is significantly greater than alternative premade bags made for the same purpose, for example Fox 6,190,044 B1.

Likewise, Sorma Netpack EP 0 788 974 A3 is also directed to the utilization of a mesh web on-vertical form, fill, and seal machines for improved packaging of perishable items. EP 0 788 974 A3 requires that a pre-pared mesh-film web be utilized consisting of five parts, three parts label (comprising the front and back label panels of the bag) and two parts mesh (comprising the side gussets of the bag) This web can only be processed on a vertical form, fill, is and seal machine specifically designed to run this pre-pared mesh-film web. The bag must be formed by forming a mesh gusset on both sides of the bag by tucking a substantial part, apparently 90% or more, of the mesh material between the front and back label panels on both sides of the bag prior to transverse heat sealing. Like EP 0 677 450 A1, EP 0 788 974 A3 utilizes large film labels front and back to sandwich the mesh between the label panels in order to achieve sufficient heat seal strength of the top and bottom transverse seams of the bag. While this method reduces heat seal failures typical of most mesh-to-mesh seals, it falls short because its advantages are offset by the following deficiencies:

(1) the bag must be filled through the narrow top opening; thereby, limiting filling speeds;

(2) the finished bag must be gusseted on both sides in order to preclude mesh-to-mesh transverse direction fin seals top and bottom that would likely fail in most practical applications over 1.0 lb.;

(3) the front and back label panels dictate the finished bag width;

(4) the back label consists of two parts that must be heat sealed longitudinally in the center of the back label panel thereby interfering with the printing of the back-side label; and, (5) the finished bag cost is significantly greater than alternative premade bags made for the same purpose, for example Fox U.S. Pat. No. 6,190,044 B1.

Madderom U.S. Pat. No. 6,105,908 is directed to the utilization of a pre-pared mesh web based upon Rusert-Antonacci patent application dated Sep. 22, 1998, Ser. No. 09/158,307. Madderom U.S. Pat. No. 6,105,908 is directed to the utilization of a pre-pared mesh web with a plurality of sequentially spaced filler strips on vertical form-fill-seal equipment for improved packaging of perishable items. Madderom U.S. Pat. No. 6,105,908 directs that a pre-pared web consisting of a pre-printed fixed length label and precisely sequentially spaced thermoplastic filler strips be applied to a 100% mesh web. The thermal sealable filler strips must be precisely located and sequentially spaced on the pre-pared mesh web at the exact length of the pre-printed label applied to the 100% mesh web. If done correctly, the pre-pared web will process on a vertical form, fill, and seal machine in such a manner that the thermal sealable filler strips are located precisely in the same location as the transverse side heat seals of the finished bag. To date, Madderom U.S. Pat. No. 6,105,908 has not been economically or commercially viable and falls short because its advantages are offset by the following deficiencies:

(1) the process to make the pre-pared web is capital intensive (2) the process to make the pre-pared web requires special proprietary equipment be purchased in order to produce the pre-pared web;

(3) the process to make the pre-pared web requires special component materials because:

a. the mesh web must have very high tensile strength and low elongation properties to insure the precise location and sequential spacing of the thermal sealable filler strips within approximately +/− 0.125";

b. the pre-printed label applied to the mesh web must also have very high tensile strength and low elongation properties to insure the precise location and sequential spacing of the thermal sealable filler strips; and, c. the thermal sealable filler strips have to be a special blend of metallocine Linear Low Density Polyethylene (LLDPE) in order for the process and the finished bag to be successful;

(4) the finished pre-pared web can only be used for a specific predetermined bag size on the vertical form, fill, and seal machine; and, (5) the finished bag cost is significantly greater than alternative premade bags made for the same purpose, for example Fox U.S. Pat. No. 6,190,044 B1.

SUMMARY OF THE INVENTION

The present invention solves the above-described deficiencies within the known prior art by providing for the use of a pre-prepared mesh-film web on conventional form, fill and seal machines. According to the present invention, the pre-prepared mesh-film web is made up of approximately 50% thermal sealable plastic mesh and approximately 50% unprinted or printed film that can be either solid or perforated. The pre-prepared mesh-film web may be processed on conventional vertical form-fill-seal equipment without the need for major modifications or special equipment added to the machine, for instance, label unwinds for the front and back labels. The items may be placed in the bag through the side or the top of the bag.

The prepared mesh-film web may be printed or unprinted prior to being processed on the vertical form-fill-seal packing machine. The majority of vertical form-fill-seal machines have the ability to advance an unprinted continuous web a predetermined length as it is being processed through the vertical form, fill, and seal machine. This enables the operator adjust bag length at any time by resetting that criteria on the control panel. Likewise, the majority of vertical form, fill, and seal machines have the ability to print a continuous web while the web is being processed. This is typically done in-line prior to introduction to the forming mandrel and subsequent formation of a tube. Vertical form-fill-seal machines also enable the operator to process a printed continuous web to make a bag at a predetermined length in accordance with the bag printing or graphics. Thus, the combined options of being able to (1) process a pre-pared printed mesh-film web or (2) print an unprinted pre-pared mesh-film web in-line and (4) change bag length at any time on the unprinted pre-pared mesh-film web provides the vertical form, fill, and seal operator the ability to run a multitude of bag designs and bag sizes without having to change the unprinted pre-pared mesh-film web.

Different types of bags can be formed on different types of vertical form, fill and seal machines by modifying the specific configuration of the pre-prepared mesh-film web of the present invention for the particular package requirements or by modifying the specific configuration of the vertical form, fill, and seal machine.

For example, in some applications, it may be desirable to provide a thermal sealable zipper tape applied during the form, fill and seal process as the longitudinal fin seal is formed, and, thereafter, thermally attaching each side of the tape to the respective free longitudinal edges of the pre-pared mesh-film web.

The primary features and advantages of the invention will be apparent to those skilled in the art upon inspecting the following drawings and description thereof. Importantly, the inventive pre-pared mesh-film webs and the inventive mesh-film bags derived from these webs can be made with relative ease and without any special modifications on commercially available vertical form, fill, and seal equipment.

BRIEF DESCRIPTION OF THE DRAWINGS

There are described hereinafter in detail non-limiting embodiments of the invention with reference to, the accompanying, drawings in which like reference numerals denote similar structure and refer to like elements throughout, and in which.

Figure 1:
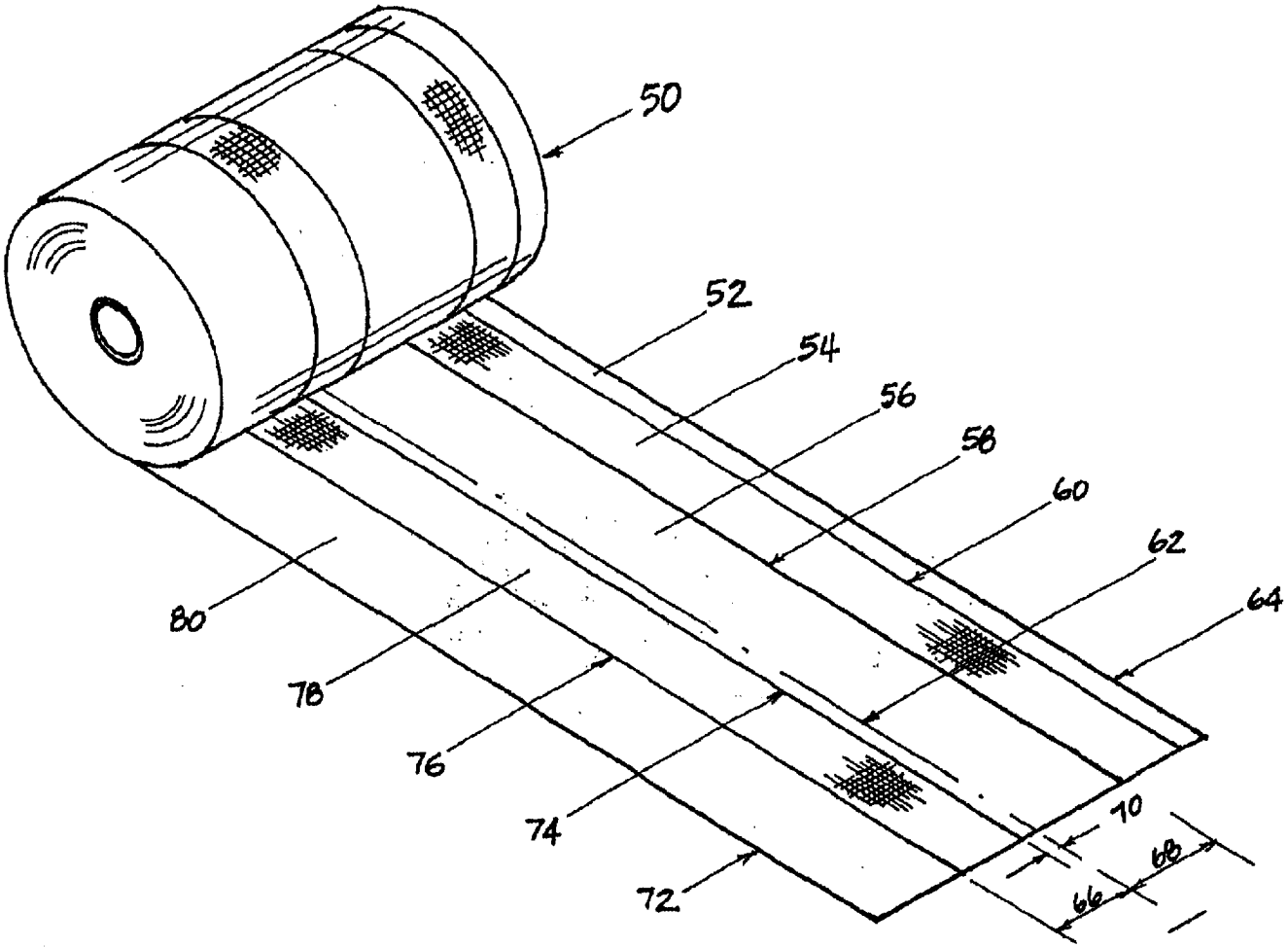
FIG. 1 is a perspective view of a pre-pared mesh-film web 50 for a vertical form, fill, and seal machine in accordance with the first embodiment of the invention.

It is to be noted that the drawings presented are intended solely for the purpose of illustration and that they are, therefore, neither desired nor intended to limit the invention to any or all of the exact details of construction shown, except insofar as they may be deemed essential to the claimed invention.

DETAILED DESCRIPTION OF THE PREFERRED EMBODIMENT

In describing preferred embodiments of the present invention illustrated in the Figures, specific terminology is employed for the sake of clarity. The invention, however, is not intended to be limited to the specific terminology so selected, and it is to be understood that each specific element includes all technical equivalents which operate in a similar manner to accomplish a similar purpose.

The preferred embodiments of the present invention are achieved by adhering to one critical design criterion when the pre-pared mesh-film web is constructed. The critical design criterion pertains to the positioning of continuous thermal sealable plastic mesh (mesh) components and continuous film components of the pre-pared mesh-film webs. The preferred embodiments of the present invention are achieved by constructing the pre-pared mesh-film web such that continuous film portion(s) on one side of the pre-pared mesh-film web longitudinal centerline align and/or match up with the continuous mesh portion(s) on the opposite side of the pre-pared mesh-film web longitudinal centerline.

Conventional vertical form, fill and seal machines contemporaneously form, fill and seal a bag from a heat sealable film continuously unwound from a roll. The process involves forming a tube from a layer of the heat sealable film unwound from the roll and heat-sealing the longitudinal edges of the film together to form a back seam for the bag. The back seam is typically either a lap seal or a fin seal. Lap seals are outside to inside heat seals made in only the longitudinal or machine direction. Fin seals are inside to inside heat seals made in either (1) the longitudinal direction (sometimes referred to as the machine direction) or (2) the transverse direction (sometimes referred to as the cross machine direction) after the tube has been formed. Transverse fin seals are inside to inside heat seals made across the collapsed tube perpendicular to the longitudinal centerline of the tube formed during the vertical form, fill, and seal process.

When the above pre-pared mesh-film web design criterion is followed, the preferred embodiments of the present, invention are achieved in the finished bag produced on a conventional vertical form, fill, and seal machine from the pre-pared mesh-film web. The resultant preferred finished bag will have (1) transverse fin seals that are preferably made up of either mesh-to-film or film-to-film heat seals and (2) a longitudinal fin seal or lap seal that is preferably made up of either mesh-to-film or film-to-film seals.

The purpose of the design criterion of the pre-pared mesh-film web is to prevent or minimize the possibility of mesh-to-mesh transverse seals and mesh-to-mesh longitudinal fin or lap seals. The same design criterion applies regardless of how many continuous film portions and continuous mesh portions make up the pre-pared mesh-film web. In theory, the web must have at least one continuous film and one continuous mesh portion, but it may also have multiple continuous film and continuous mesh portions. For instance, the pre-pared mesh-film web may have 3, 4, 5, 6, 7, 8, or more continuous mesh and film components, approximately half of which must be film and the other half mesh. In practice, the number of continuous mesh and film components in each pre-pared mesh-film web is expected to be from 2 to 6, of which approximately half will be film and half will be mesh.

The film is preferably a thermoplastic, characterized by having one or more layers, wherein at least one outer layer of the film is heat sealable according to means well-known in the art and consistent with the purposes described hereinbelow. Such films may comprise polyethylene, polypropylene, polyester, nylon, or other olefin-based materials, or the like, in the form of a single ply, a laminated or a coextruded film.

The thermal sealable plastic mesh is preferably a non-woven, polyethylene mesh sold under the trade name CLAF®. CLAF mesh is available from Atlanta Nisseki CLAF, Inc., Atlanta, Ga. CLAF mesh provides sufficient strength for heavy-duty packaging applications, while at the same time allows packaged products to be seen easily and to breathe when it is desirable.

Laboratory test data shown in Table 1 below indicates that is side seam fin seals made by heat-sealing CLAF mesh to CLAF mesh resulted in side seam fin seal strengths that were weak and inconsistent, ranging in strength from 1.1 to 3.1 lbs. per 2 inch. This reference is from U.S. patent application Ser. No. 09/158,307. This application is dated Sep. 22, 1998. As per Ser. No. 09/158,307 2-inch wide tensile test strips were used. Indication is also given in the table below as to "Side In" which refers to which side of the fabric, having machine direction (MD) strands and transverse direction (TD) strands laminated to each other, was facing inward as the seam was heat-sealed. The side-seams of Samples A–D were heat sealed with seal bar maintained at temperatures of 310° or 320° F., a pressure of 60 pounds per square inch (psi) and dwell times of 0.75 or 1.25 seconds. The tensile test strips were prepared so that the fin type seal was in the center of the sample and perpendicular to the test direction according to ASTM D 110108-95. Laboratory test data is summarized in Table 1 below:

TABLE 1

| | Test Conditions | | Dwell Time, | Seam Strength |
|---|---|---|---|---|
| Sample | Temp. ° F. | Side In | sec | lbs/2-inch |
| A | 310 | TD | 0.75 | 2.0 |
| A | 310 | MD | 0.75 | 2.8 |
| A | 310 | TD | 1.25 | 1.9 |
| A | 310 | MD | 1.25 | 2.8 |
| A | 320 | TD | 0.75 | 1.8 |
| A | 320 | MD | 0.75 | 3.1 |
| B | 310 | TD | 0.75 | 1.9 |
| B | 310 | TD | 1.25 | 2.5 |
| B | 320 | TD | 1.25 | 2.3 |
| B | 320 | TD | 0.75 | 2.1 |
| C | 310 | TD | 0.75 | 1.1 |
| C | 310 | TD | 1.25 | 1.1 |
| C | 320 | TD | 1.25 | 1.2 |
| D | 310 | TD | 1.25 | 1.1 |
| D | 310 | MD | 1.25 | 2.4 |
| D | 320 | TD | 0.75 | 1.3 |

The far right column in Table 2 above shows the range of transverse and longitudinal fin seal seam strengths for CLAF mesh-to-CLAF mesh fin seals. These seam strengths ranging from 1.1 to 3.1 lbs. per 2 inch preclude the use of CLAF mesh-to-CLAF mesh fin seals in most commercial packaging applications for packages greater than 1#. The same test data is not readily available for most other commercial mesh materials. However, those skilled in the art of heat sealing mesh materials would recognize that since most other commercial mesh materials have less surface area than the preferred mesh CLAF and therefore would likely have lower heat seal strength if prepared and tested in the same manner.

Initial laboratory test data shown in Table 2 below indicates that transverse fin seals made by heat-sealing CLAF mesh to two polyethylene films typically used for commercial polyethylene bags (1.5 & 2.0 mils thick) resulted in fin seal seam strengths that were significantly stronger than the above CLAF mesh-to-mesh fin seal seam strengths. For samples tested and summarized below tests were conducted in the same manner using 2-inch wide tensile test strips. The transverse fin seals were heat sealed on a conventional vertical form, fill, and seal machine with one side of the transverse or cross heat seal bar maintained at 350° F. and the other side at ambient temperature. The dwell time was set at 0.15 seconds. The ambient transverse seal bar face was covered with a 0.125" thick layer of silicone rubber. The tensile test strips were prepared so that the fin type seal was in the center of the sample and perpendicular to the test direction according to ASTM D 110108-95. Laboratory test data is summarized in Table 2 below:

TABLE 2

| Polyethylene Film Thickness | Number of Test Samples | Fin Seal Seam Strength (lbs per 2-inch strip) Low | High | Average | St'd Deviation |
|---|---|---|---|---|---|
| 2.0 mil | 6 | 6.3 | 10.6 | 8.9 | 1.5 |
| 1.5 mil | 18 | 7.3 | 10.3 | 8.9 | 0.9 |

The above fin seal seam strengths shown in Table 2 compare favorably to the strength of transverse and longitudinal film-to-film fin seals for polyethylene bags in commercial use for potatoes and other fruits and vegetables.

In accordance with the first embodiment of the present invention, FIG. 1 shows a pre-pared mesh-film web 50 for vertical form-fill-seal packaging machines. Pre-pared mesh-film web 50 having longitudinal edges 64 and 72 and longitudinal centerline 62, has five continuous webs comprising film 52, mesh 54, film 56, mesh 78, and film 80 connected to each other by continuous longitudinal heat seals 58, 60, 74, and 76.

FIG. 1 also shows the critical dimensions 66, 68, and 70 that are fixed by the designer to insure that continuous mesh portions 54 and 78 of the pre-pared mesh-film web 50 align opposite continuous film portions 80 and 56 respectively of the pre-pared mesh-film web after the pre-pared mesh-film web 50 has been folded along its longitudinal centerline 62 by the vertical form, fill, and seal machine.

Figure 2:
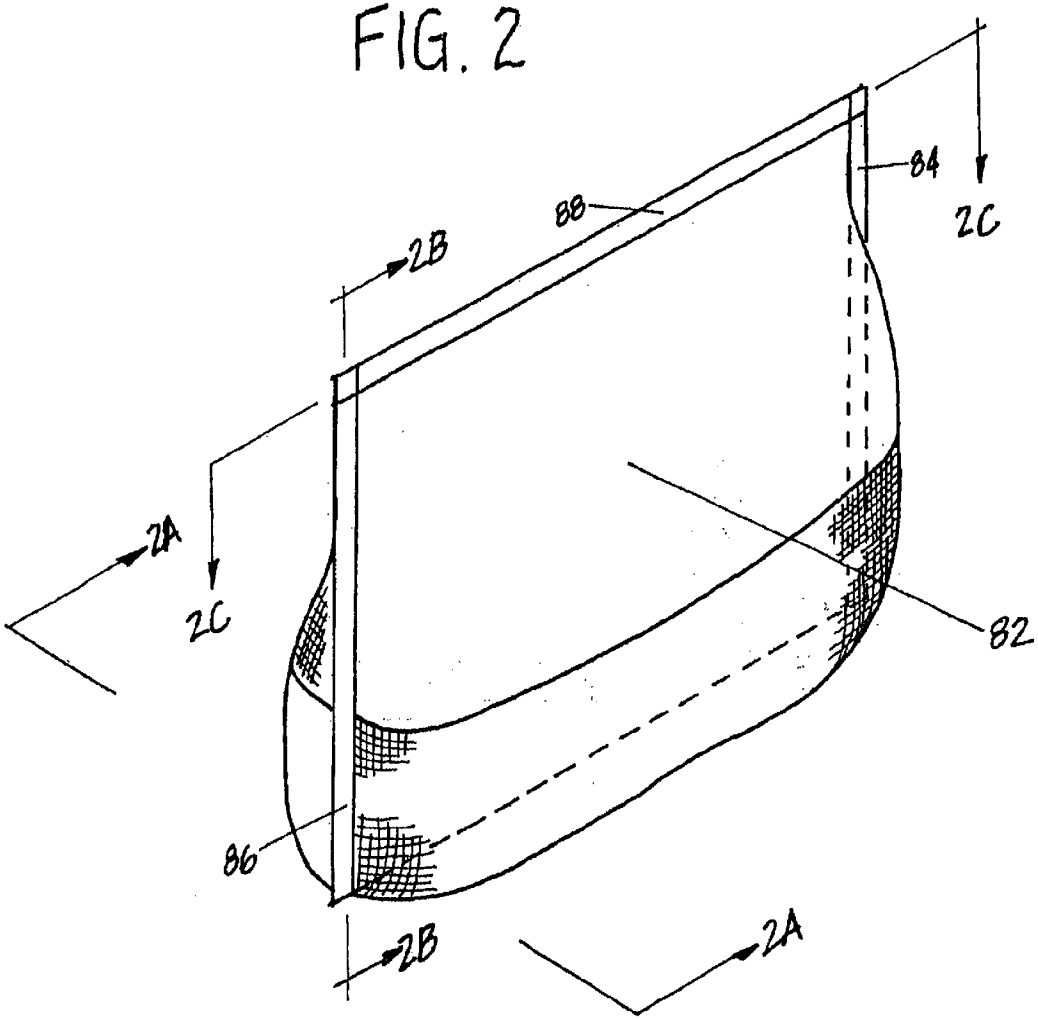
FIG. 2 is a perspective view of mesh-film bag 82 produced on a vertical form, fill, and seal machine from the pre-pared mesh-film web in FIG. 1 with a longitudinal fin seal.

The preferred embodiments of the present invention are achieved in the finished bag 82 shown in FIG. 2.

Bag 82 is the finished bag of pre-pared mesh-film web 50 after processing on a conventional vertical form, fill, and seal machine.

Figure 2A:
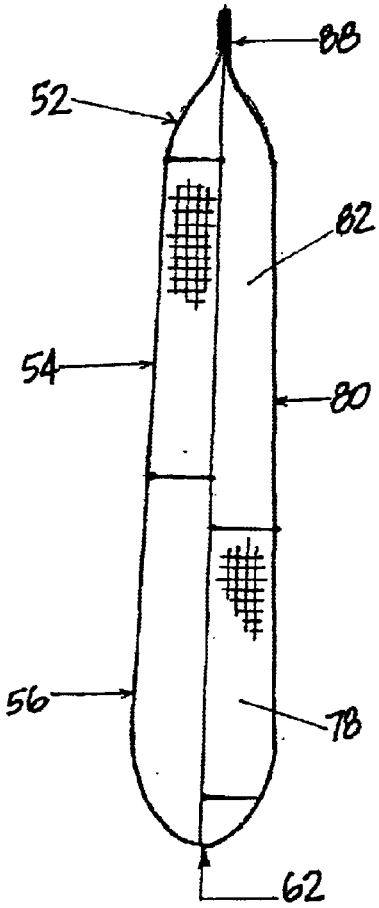
FIG. 2A is a side view of the bag of FIG. 2.

FIG. 2A is a side view of bag 82 showing the alignment of mesh always opposite film on the front and back of the bag. The preferred make-up of the pre-pared mesh-film web 50 aligns continuous film portions 56 and 80 on one side of the pre-pared mesh-film web longitudinal centerline 62 with the continuous mesh portions 54 and 78 on the opposite side of the pre-pared mesh-film web longitudinal centerline after the pre-pared mesh-film web has been folded along its longitudinal centerline 62 by the vertical form, fill, and seal machine.

Figure 2B:
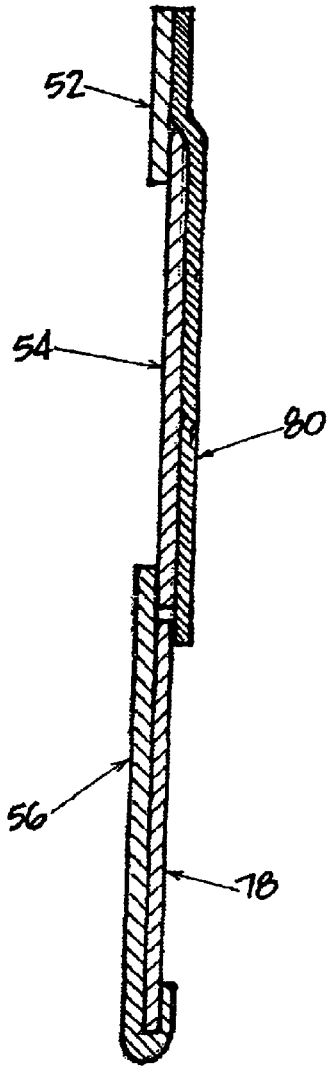
FIG. 2B is a cross section of transverse fin seal 84 of the bag of FIG. 2.

FIG. 2B is a cross section view of transverse fin seal 86 of bag 82 showing the alignment of mesh portions 54 and 78 opposite film portions 56 and 80 respectively in transverse fin seal 86. Transverse fin seal 84 on the opposite side of bag 82 is the same.

Figure 2C:
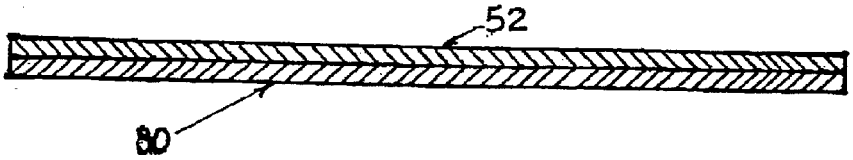
FIG. 2C is a cross section of longitudinal fin seal 88 of the bag of FIG. 2.

FIG. 2C is a cross section view of longitudinal fin seal 88 of bag 82 showing an alternative preferred alignment of film 52 opposite film 80.

Figures 3A, 3B:
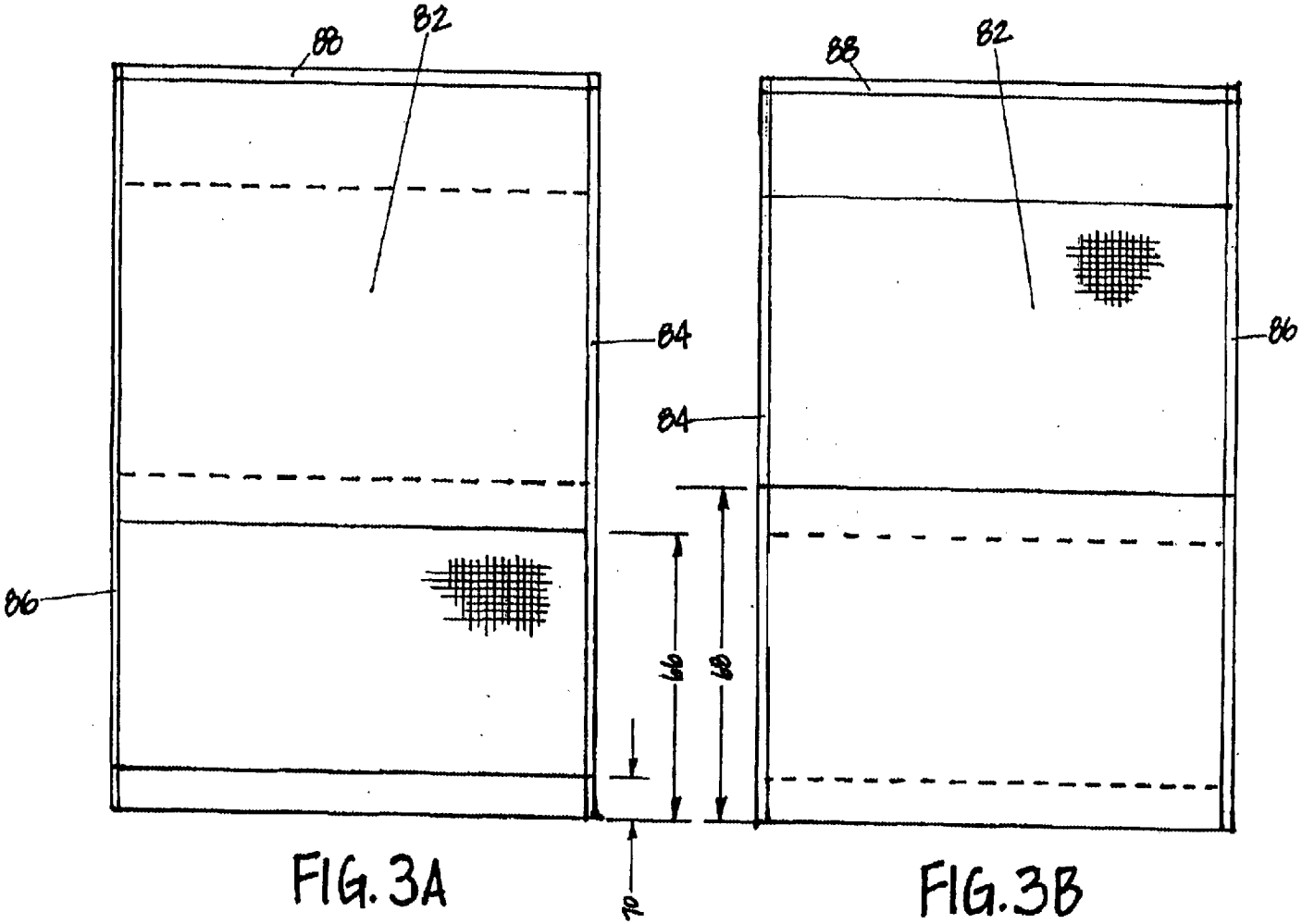
FIG. 3A is the front view of the bag of FIG. 2.
FIG. 3B is the back view of the bag of FIG. 2.

FIGS. 3A and 3B are the front and back views respectively of bag 82 having transverse fin seal 86 left, transverse fin seal 84 right, and longitudinal fin seal 88 on top.

Referring to FIGS. 1, 2, 2A, 2B, 3A and 3B, bag 82 produced from pre-pared mesh-film web 50 on a vertical form, fill, and seal machine formed has a top fin seal 88 and transverse side fin seal 84 and 86 strong enough to withstand heavy-duty applications. The preferred embodiments of the present invention are achieved by constructing the pre-pared mesh-film web 50 such that continuous film portions 56 and 80 on one side of pre-pared mesh-film web 50 longitudinal centerline 62 align and/or match up with the continuous mesh portions 54 and 78 on the opposite side of pre-pared mesh-film web 50 longitudinal centerline 62. The critical dimensions 66 and 70 that are fixed by the designer to position continuous mesh portion 78 opposite continuous film portion 56 after pre-pared mesh-film web 50 has been folded along its longitudinal centerline 62 by the vertical form, fill, and seal machine. Likewise, critical dimension 68 is fixed by the designer to position continuous mesh portion 54 opposite continuous film portion 80 after pre-pared mesh-film web 50 has been folded along its longitudinal centerline 62 by the vertical form, fill, and seal machine.

Referring now to FIG. 2, it is preferable to have 100% of transverse fin seals 84 and 86 to be mesh-to-film seals and longitudinal fin seal 88 to be film-to-film. However, it may be possible to allow a small percentage, perhaps approximately 10% of fin seals 84, 86, and 88 to be mesh-to-mesh heat seals as long as the package integrity is not sacrificed. This can be judged on a case-by-case basis, for example utilizing drop test results as the pass-fail criteria.

Figure 4:
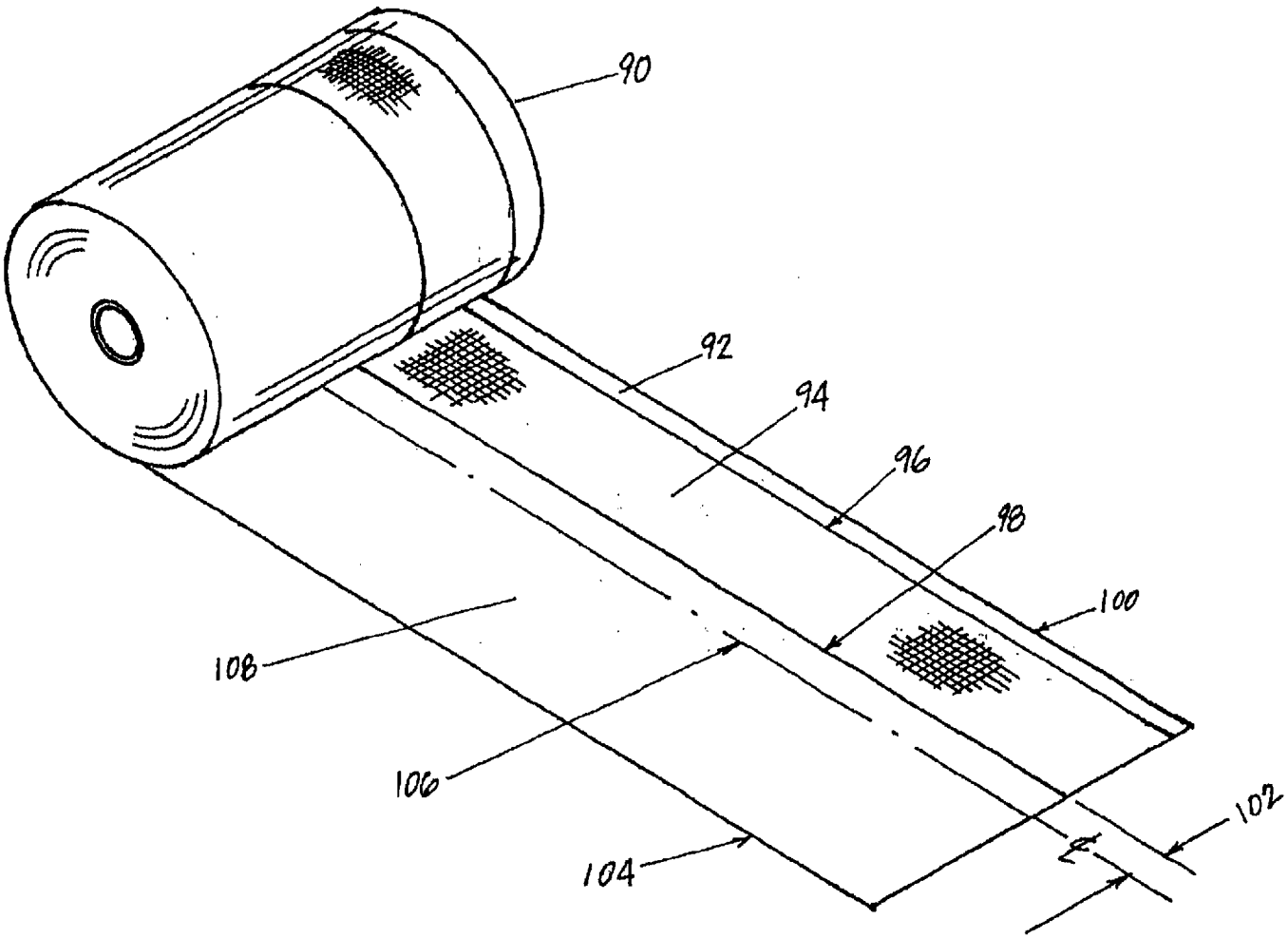
FIG. 4 is a perspective view of pre-pared mesh-film web 90 for a vertical form, fill, and seal machine in accordance with the second embodiment of the invention.

In accordance with the second embodiment of the present invention, FIG. 4 shows a pre-pared mesh-film web 90 for vertical form-fill-seal packaging machines. Pre-pared mesh-film web 90 having longitudinal edges 100 and 104 and longitudinal centerline 106 has three continuous webs comprising film 92, mesh 94, and film 108 connected to each other by continuous longitudinal heat seals 96 and 98.

FIG. 4 also shows the critical dimension 102 that is fixed by the designer to insure that continuous mesh portion 94 of the pre-pared mesh-film web 90 aligns opposite continuous film portion 108 of the pre-pared mesh-film web after the pre-pared mesh-film web 90 has been folded along its longitudinal centerline 106 by the vertical form, fill, and seal machine.

Figure 5:
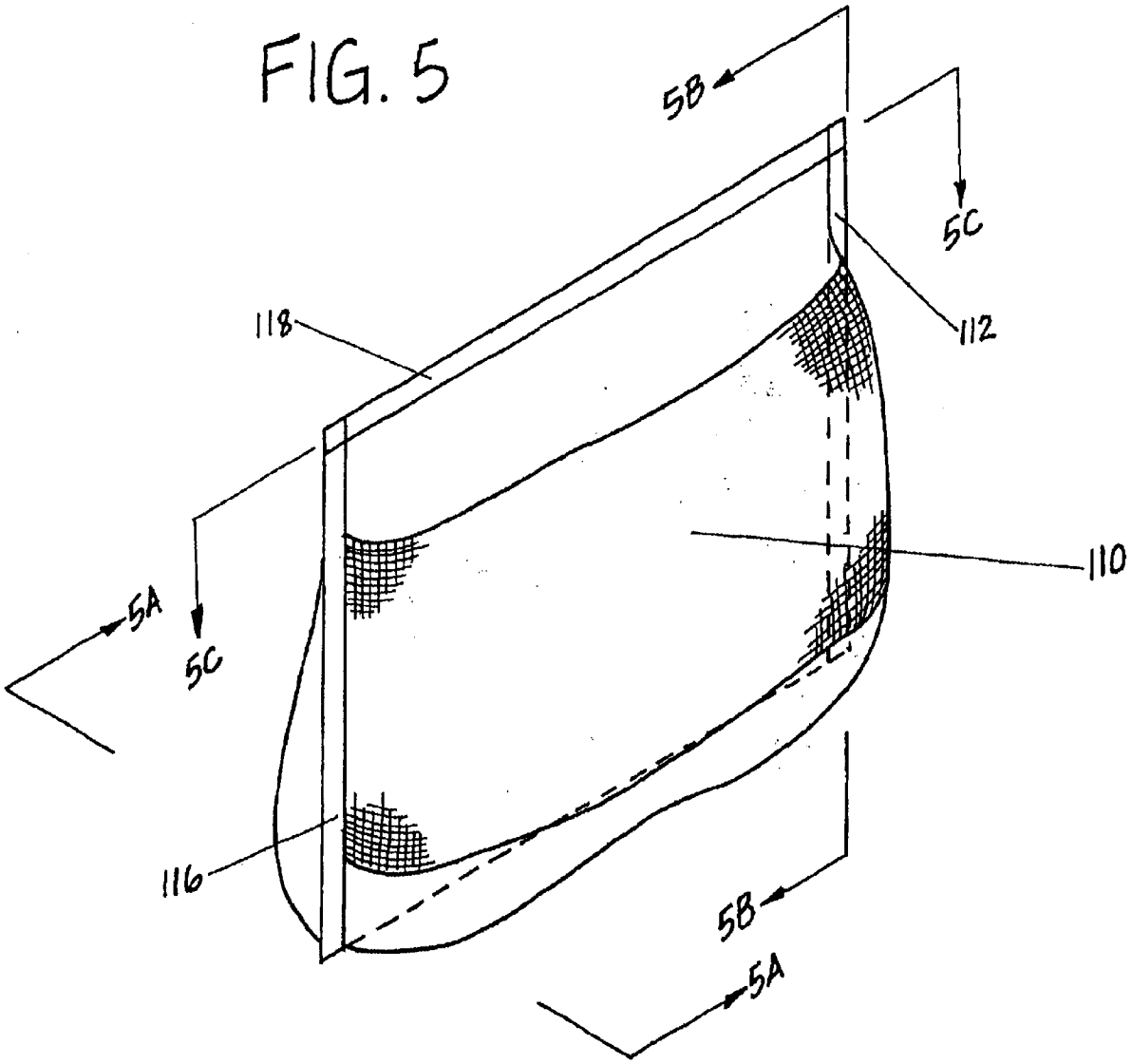
FIG. 5 is a perspective view of mesh-film: bag 110 produced on a vertical form, fill, and seal machine from the pre-pared mesh-film web in FIG. 4 with a longitudinal fin seal.

The preferred embodiments of the present invention are achieved in the finished bag 110 shown in FIG. 5. Bag 110 is the finished bag of pre-pared mesh-film web 90 after processing on a conventional vertical form, fill, and seal machine.

Figure 5A:
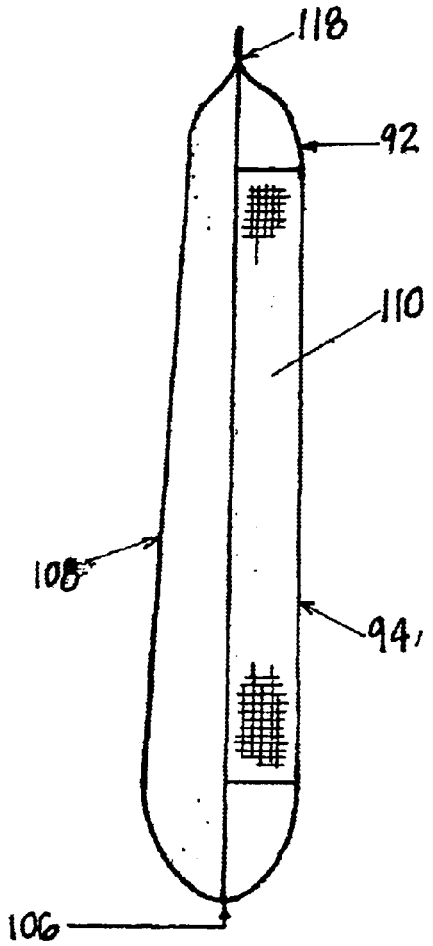
FIG. 5A is a side view of the bag of FIG. 5.

FIG.5A is a side view of bag 110 showing the alignment of mesh always opposite film on the front and back of the bag. The preferred make-up of the pre-pared mesh-film web 90 aligns continuous film portion 108 on one side of the pre-pared mesh-film web longitudinal centerline 106 with continuous mesh portion 94 on the opposite side of the pre-pared mesh-film web longitudinal centerline 106 after the pre-pared mesh-film web has been folded along its longitudinal centerline 106 by the vertical form, fill, and seal machine.

Figure 5B:
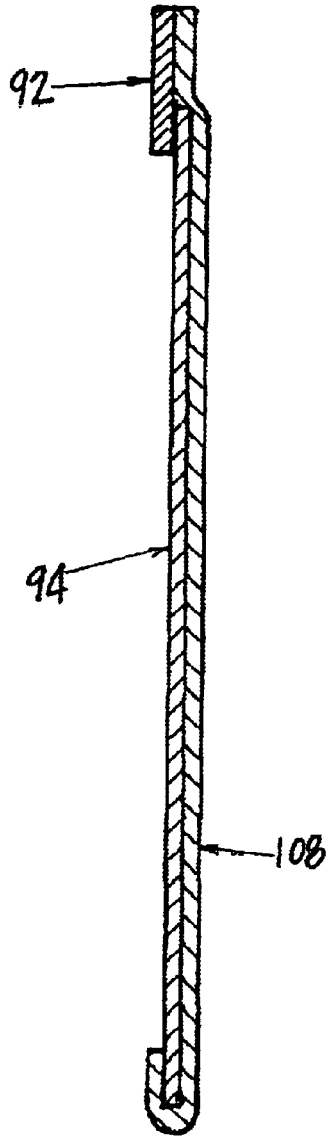
FIG. 5B is a cross section of transverse fin seal 112 of the bag of FIG. 5.

FIG. 5B is a cross section view of transverse fin seal 112 of bag 110 showing the alignment of mesh portion 94 opposite film portion 108 in transverse fin seal 112. Transverse fin seal 116 on the opposite side of bag 110 is the same.

Figure 5C:
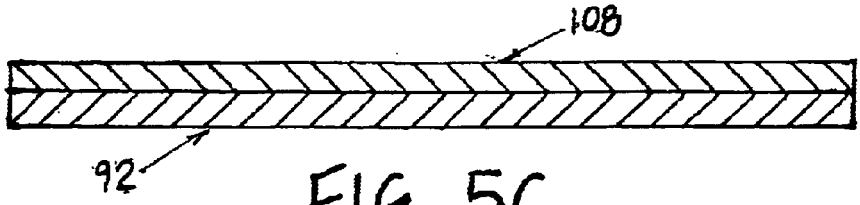
FIG. 5C is a cross section of longitudinal fin seal 118 of the bag of FIG. 5.

FIG. 5C is a cross section view of longitudinal fin seal 118 of bag 110 showing an alternative preferred alignment of film 92 opposite film 108.

Figure 6B:
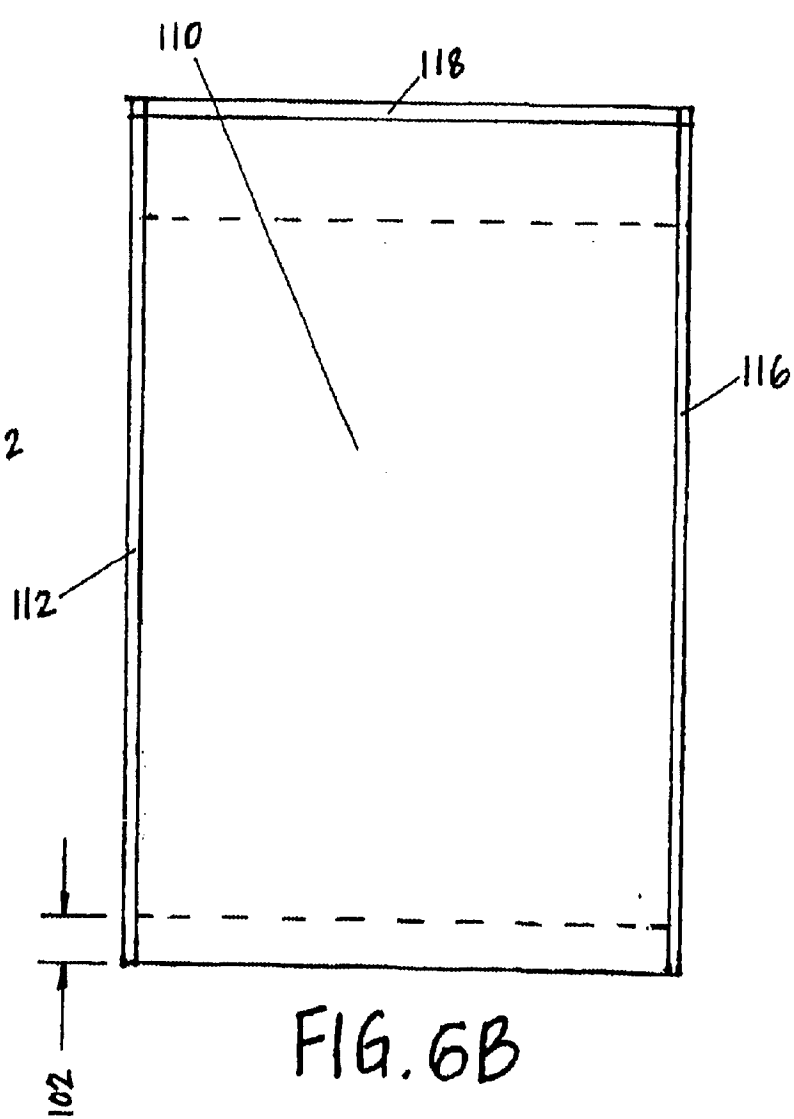
FIG. 6B is the back view of the bag of FIG. 5.
Figure 6A:
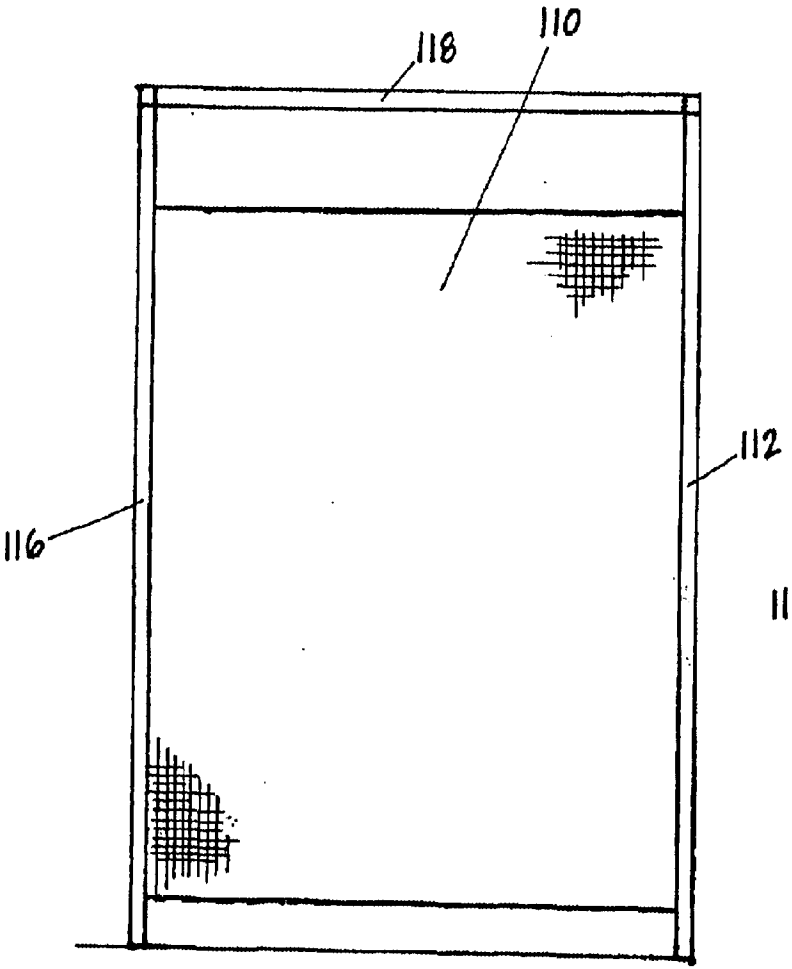
FIG. 6A is the front view of the bag of FIG. 5.

FIGS. 6A and 6B are the front and back views respectively of bag 110 having transverse fin seal 116 left, transverse fin seal 112 right, and longitudinal fin seal 118 on top.

Referring to FIGS. 4, 5, 5A, 5B, 6A, and 6B, the bag 110 produced from pre-pared mesh-film web 90 on a vertical form, fill, and seal machine formed has a top fin seal 118 and transverse side fin seal 112 and 116 strong enough to withstand heavy-duty applications. The preferred embodiments of the present invention are achieved by constructing the pre-pared mesh-film web 90 such that continuous film portion 108 on one side of pre-pared film web 90 longitudinal centerline 106 align and/or match up with continuous mesh portion 94 on the opposite side of pre-pared mesh-film web 90 longitudinal centerline 106. The critical dimension 102 that is fixed by the designer to position continuous mesh portion 94 opposite continuous film portion 108 after pre-pared mesh-film web 90 has been folded along its longitudinal centerline 106 by the vertical form, fill, and seal machine.

Referring now to FIG. 5, it is preferable to have 100% of transverse fin seals 112 and 116 to be mesh-to-film seals and longitudinal fin seal 118 to be film-to-film. However, it may be possible to allow a small percentage, perhaps approximately 10% of fin seals 112, 116, and 118 to be mesh-to-mesh heat seals as long as the package integrity is not sacrificed. This can be judged on a case-by-case basis, for example utilizing drop test results as the pass-fail criteria.

Figure 7:
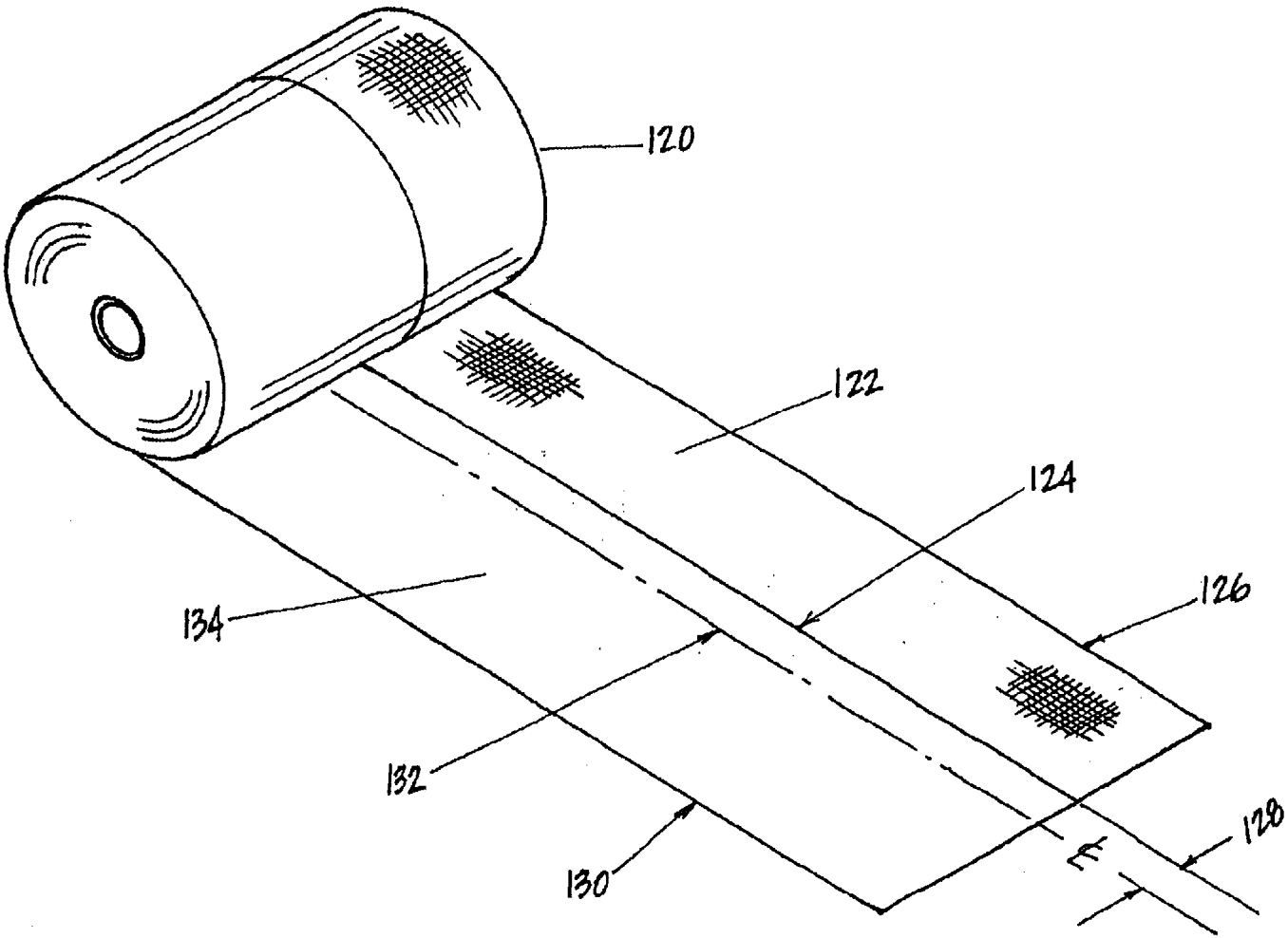
FIG. 7 is a perspective view of a pre-pared mesh-film web 120 for a vertical form, fill, and seal machine in accordance with the third embodiment of the invention.

In accordance with the third embodiment of the present invention, FIG. 7 shows a pre-pared mesh-film web 120 for vertical form-fill-seal packaging machines. Pre-pared mesh-film web 120 having longitudinal edges 126 and 130 and longitudinal centerline 132 has two continuous webs comprising film 134 and mesh 122, connected to each other by continuous longitudinal heat seal 124.

FIG. 7 also shows the critical dimension 128 that is fixed by the designer to insure that continuous mesh portion 122 of the pre-pared mesh-film web 120 aligns opposite continuous film portion 134 of the pre-pared mesh-film web after the pre-pared mesh-film web 120 has been folded along its longitudinal centerline 132 by the vertical form, fill, and seal machine.

Figure 8:
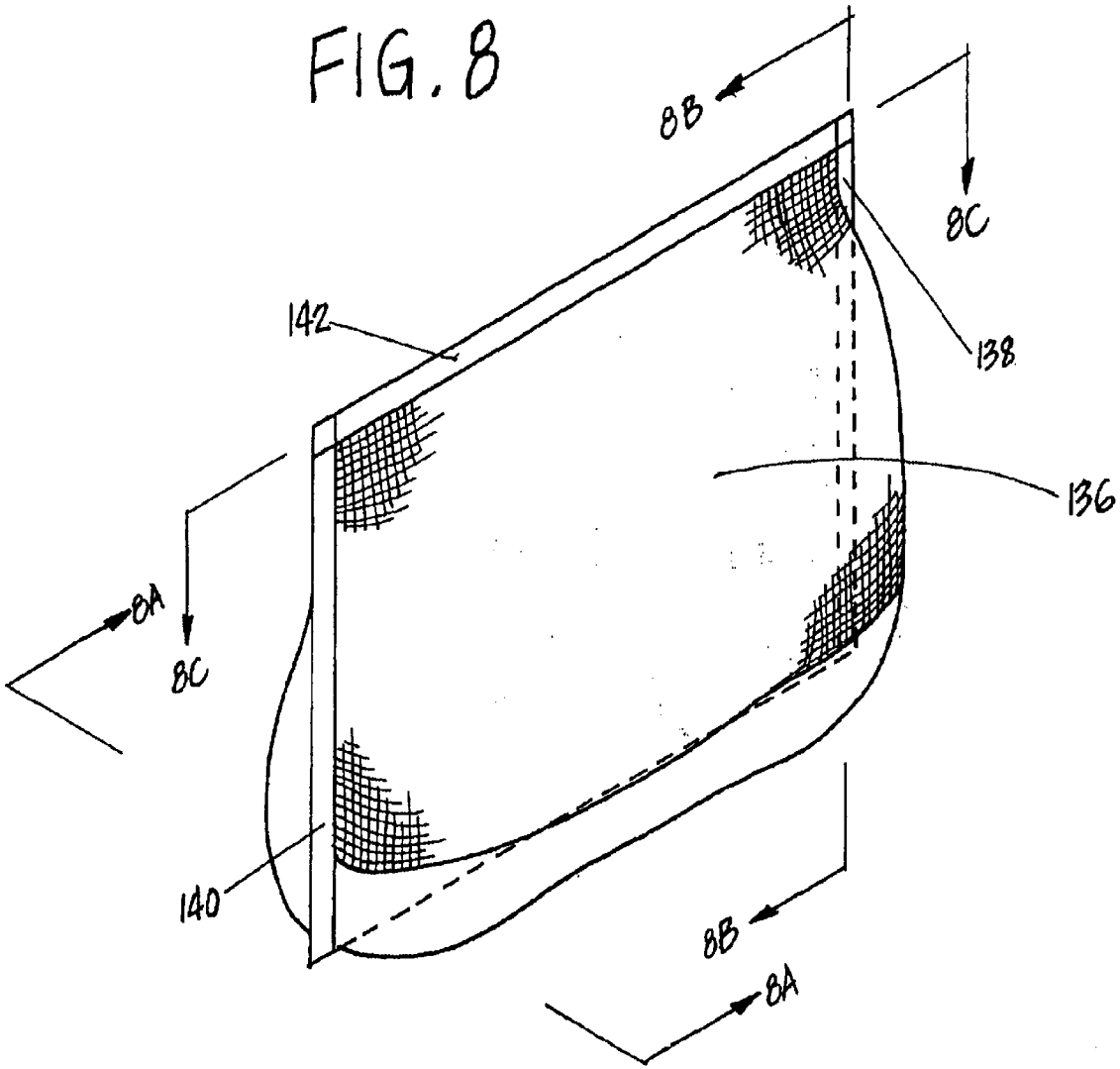
FIG. 8 is a perspective view of mesh-film bag 136 produced on a vertical form, fill, and seal machine from the pre-pared mesh-film web in FIG. 7 with a longitudinal fin seal.

The preferred embodiments of the present invention are achieved in the finished bag 136 shown in FIG. 8. Bag 136 is the finished bag of pre-pared mesh-film web 120 after processing on a conventional vertical form, fill, and seal machine.

Figure 8A:
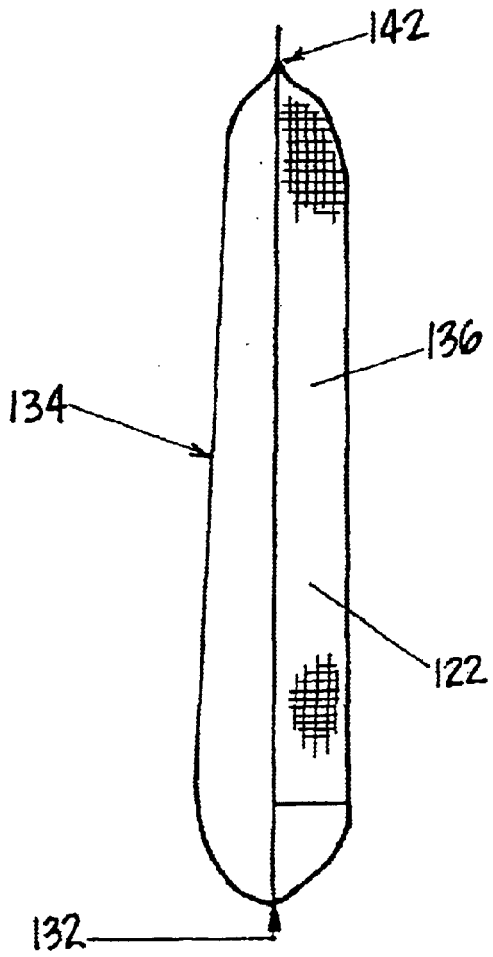
FIG. 8A is a side view of the bag of FIG. 8.

FIG. 8A is a side view of bag 136 showing the alignment of mesh always opposite film on the front and back of the bag. The preferred make-up of the pre-pared mesh-film web 120 aligns continuous film portion 134 on one side of the pre-pared mesh-film web longitudinal centerline 132 with continuous mesh portion 122 on the opposite side of the pre-pared mesh-film web longitudinal centerline 132 after the pre-pared mesh-film web has been folded along its longitudinal centerline 132 by the vertical form, fill, and seal machine.

Figure 8B:
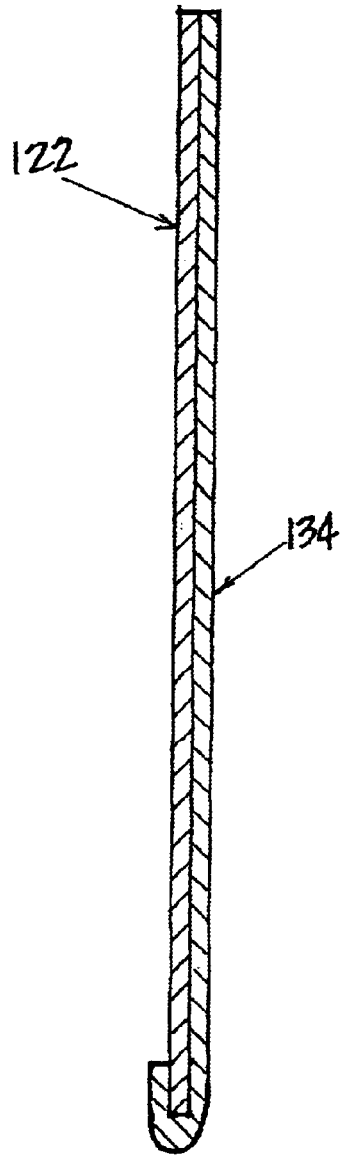
FIG. 8B is a cross section of transverse fin seal 138 of the bag of FIG. 8.

FIG. 8B is a cross section view of transverse fin seal 138 of bag 136 showing the alignment of mesh portion 122 opposite film portion 134 in transverse fin seal 138. Transverse fin seal 140 on the opposite side of bag 136 is the same.

Figure 8C:
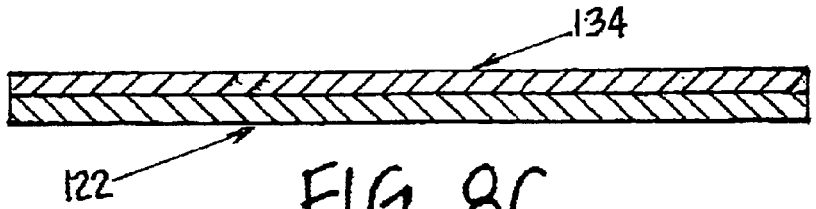
FIG. 8C is a cross section of longitudinal fin seal 142 of the bag of FIG. 8.

FIG. 8C is a cross section view of longitudinal fin seal 142 of bag 136 showing an alternative preferred alignment of film 122 opposite film 134.

Figure 9B:
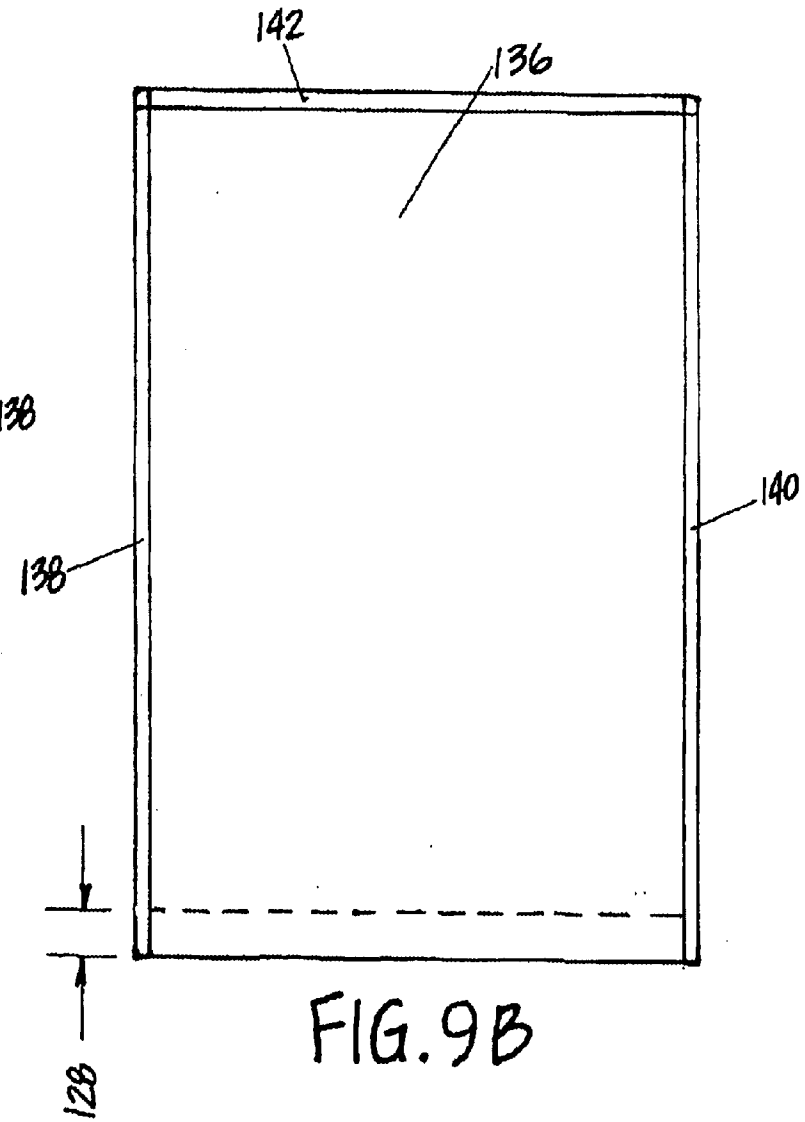
FIG. 9B is the back view of the bag of FIG. 8.
Figure 9A:
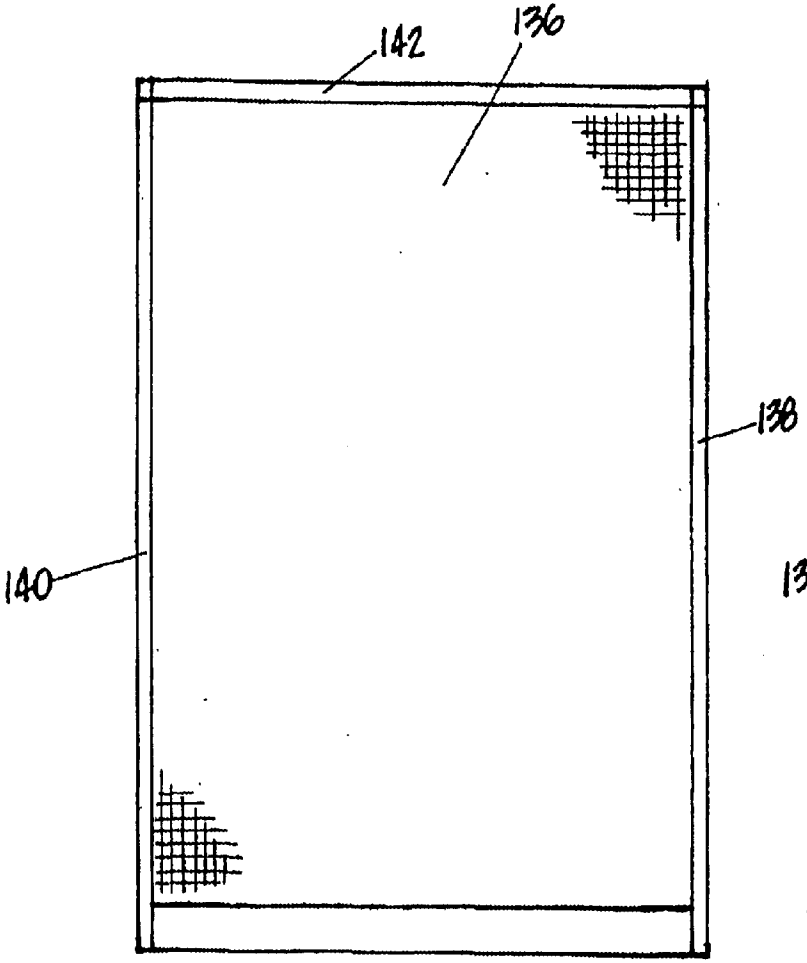
FIG. 9A is the front view of the bag of FIG. 8.

FIGS. 9A and 9B are the front and back views respectively of bag 136 having transverse fin seal 140 left, transverse fin seal 138 right, and longitudinal fin seal 142 on top.

Referring to FIGS. 7, 8, 8A, 8B, 9A, and 9B, the bag 136 produced from pre-pared mesh-film web 120 on a vertical form, fill, and seal machine formed has a top fin seal 142 and transverse side fin seal 138 and 140 strong enough to withstand heavy-duty applications. The preferred embodiments of the present invention are achieved by constructing the pre-pared mesh-film web 120 such that continuous film portion 134 on one side of pre-pared mesh-film web 120 longitudinal centerline 132 align and/or match up with continuous mesh portion 122 on the opposite side of pre-pared mesh-film web 120 longitudinal centerline 132. The critical dimension 128 that is fixed by the designer to position continuous mesh portion 122 opposite continuous film portion 134 after pre-pared mesh-film web 120 has been folded along its longitudinal centerline 132 by the vertical form, fill, and seal machine.

Referring now to FIG. 8, it is preferable to have 100% of transverse fin seals 138 and 140 to be mesh-to-film seals and longitudinal fin seal 142 to be film-to-film. However, it may be possible to allow a small percentage, perhaps approximately 10% of fin seals 138, 140, and 142 to be mesh-to-mesh heat seals as long as the package integrity is not sacrificed. This can be judged on a case-by-case basis, for example utilizing drop test results as the pass-fail criteria.

Figure 10B:
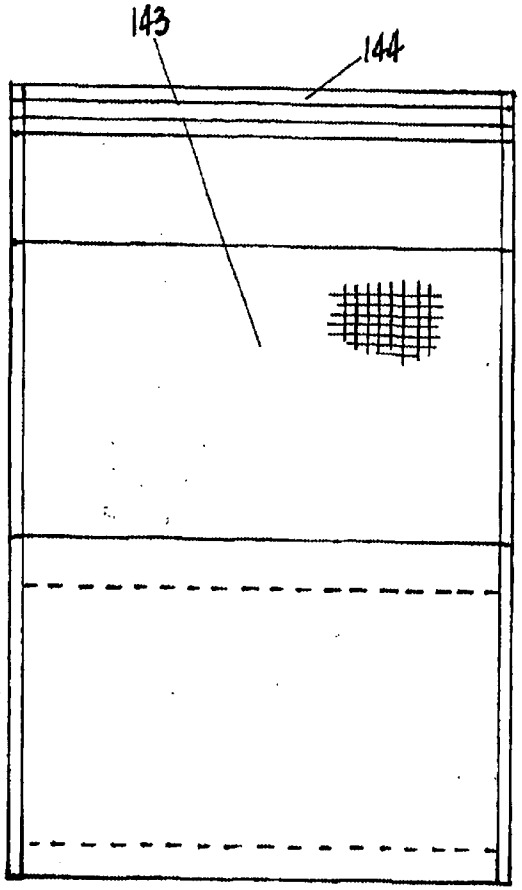
FIG. 10B is the back view of mesh-film bag 143 of FIG. 10A.
Figure 10A:
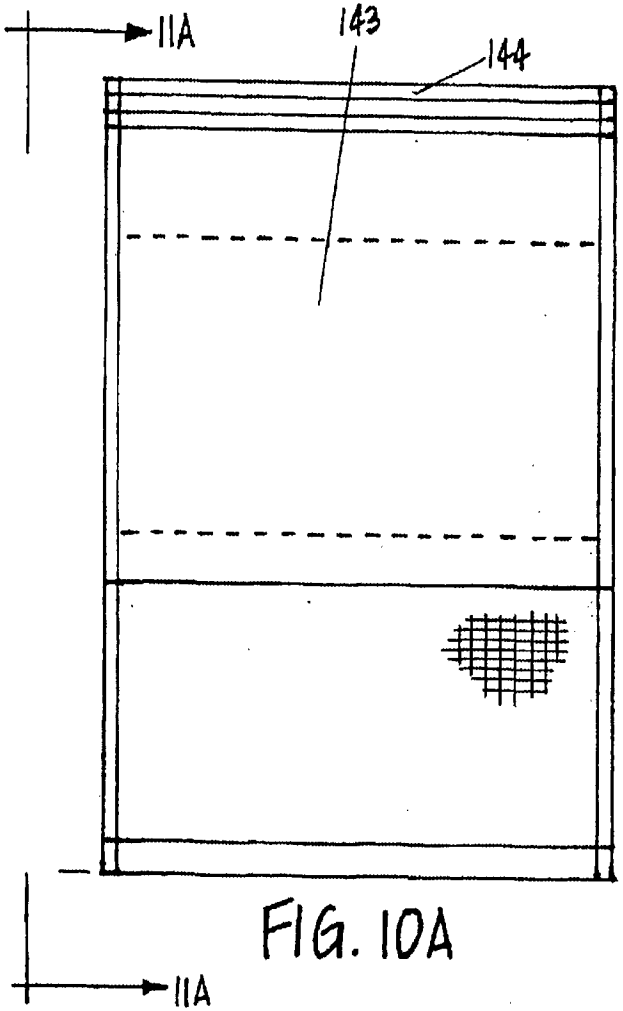
FIG. 10A is the front view of mesh-film bag 143 with a re-closable zipper added attached to the longitudinal fin seal.

Another preferred embodiment of the present invention is shown in FIGS. 10A and 10B. Some vertical form, fill, and seal machines have the ability to apply a recloseable zipper along the longitudinal fin seal during the form, fill, and seal process. FIGURES 10A and 10B show front and back views respectively of bag 143 with recloseable zipper 144 attached. Bag 143 is essentially the same as bag 82 shown in FIG. 2A with the exception of the added recloseable zipper 144. Bags 82 and 142 can be made from the same pre-pared mesh-film web 50. Bag 142 is the finished bag of pre-pared mesh-film web 50 with recloseable zipper 144 applied during the vertical form, fill, and seal process.

Figure 11A:
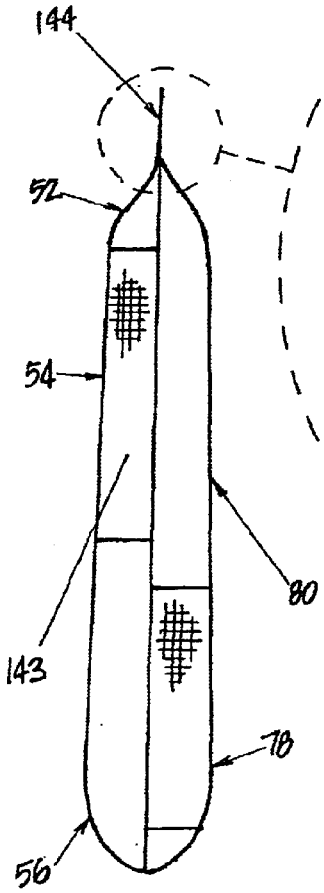
FIG. 11A is the side view of the bag of FIG. 10A

FIG. 11A is a side view of bag 142 showing alignment of mesh always opposite film on the front and back of the bag with the recloseable zipper 144 on top.

Figure 11B:
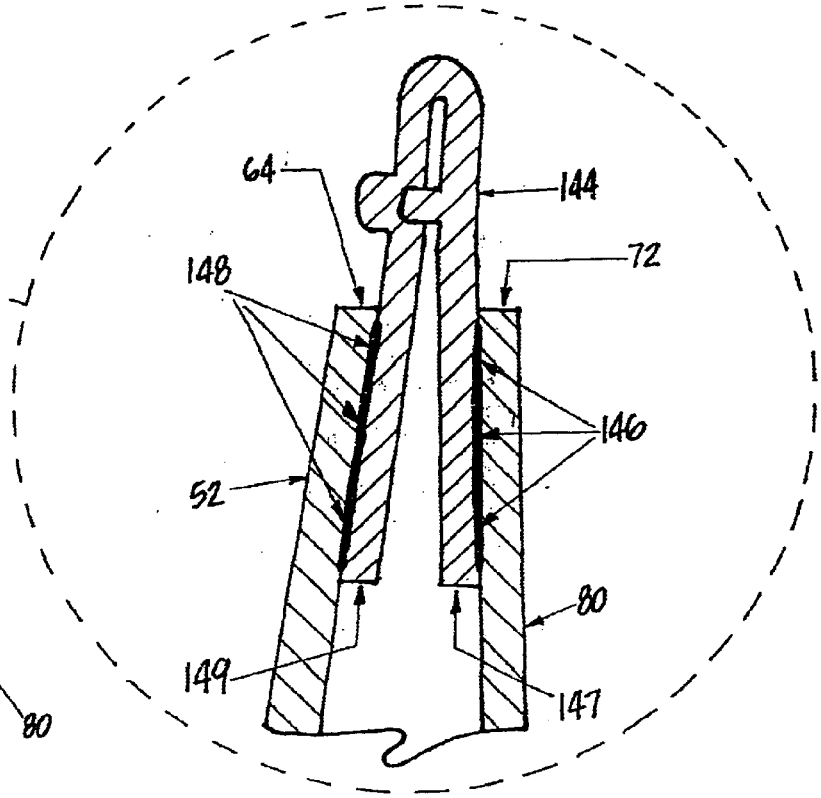
FIG. 11B is an enlarged view of the recloseable zipper attached to the top of the bag of FIG. 10A.

FIG. 11B is an enlarged cross section view of the top of bag 142 showing thermoplastic flanges 147 and 149 of recloseable zipper 144 heat sealed to the longitudinal edges 64 and 72 of pre-pared mesh-film web 50 in the vicinity of 146 and 148 along continuous film portions 52 and 80 of pre-pared mesh-film web 50.

Another preferred embodiment of the present invention is shown in FIGS. 12A, 12B, 13A, and 13B.

Vertical form, fill, and seal machines may also be fitted with a forming mandrel that has the ability to form a tube with a longitudinal lap seal instead of a longitudinal fin seal.

Figure 12B:
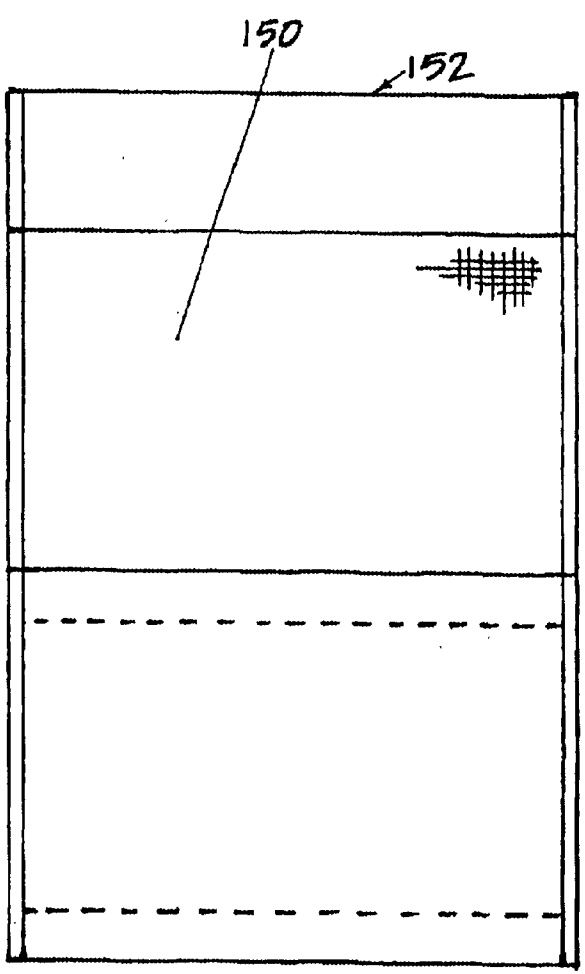
FIG. 12B is the back view of the bag of FIG. 12A.
Figure 12A:
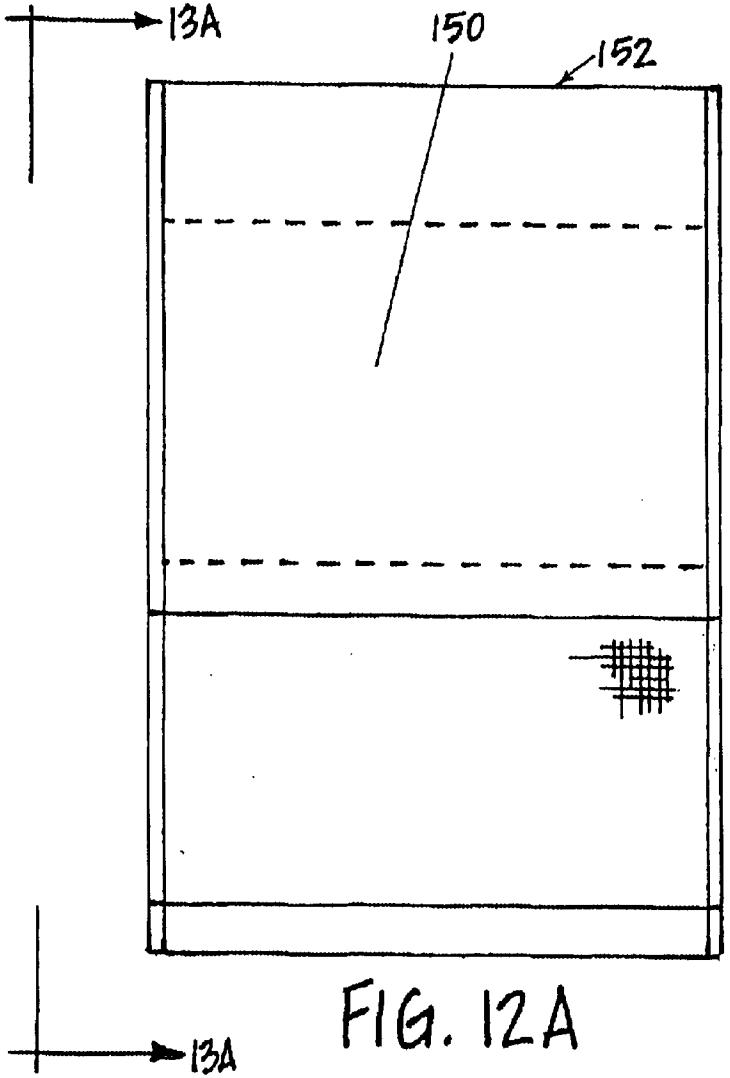
FIG. 12A is the front view of mesh-film bag 150 produced on a vertical form, fill, and seal machine from the pre-pared mesh-film web in FIG. 1 with a longitudinal lap seal; is

FIGS. 12A and 12B show the front and back views respectively of bag 150 with a longitudinal lap seal 152. Bag 150 is essentially the same as bag 82 shown in FIG. 2A with the exception of the longitudinal lap seal 152 replacing longitudinal fin seal 88.

Figure 13B:
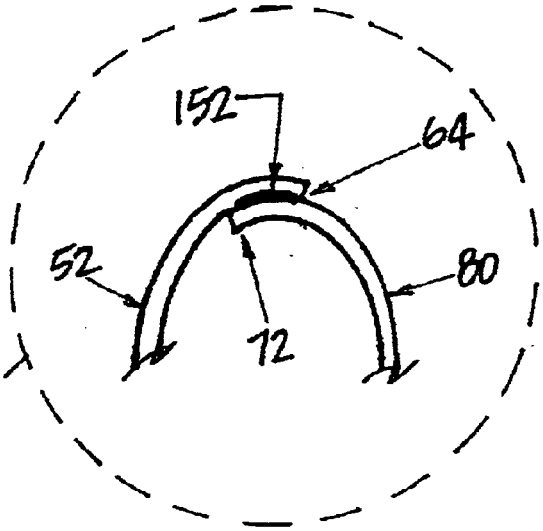
FIG. 13B is an enlarged view of the longitudinal lap seal of the bag of FIG. 12A.
Figure 13A:
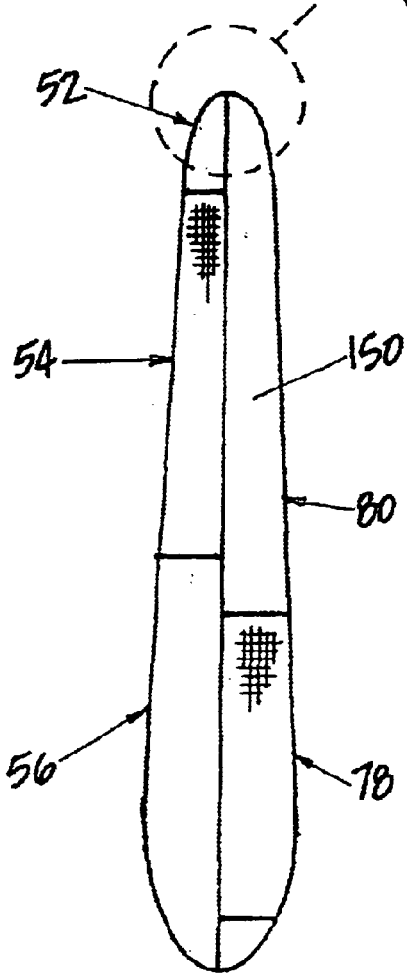
FIG. 13A is the side view of the bag of FIG. 12A.

FIG. 13A is a side view of bag 150 showing alignment of mesh always opposite film on the front and back of the bag with longitudinal lap seal 152.

FIG. 13B is an enlarged cross section view of the top of bag 150 showing lap seal 152. The lap seal of FIG. 13B was formed on a vertical form, fill, and seal machine fitted with a forming mandrel that has the ability to guide first longitudinal edge 64 and second longitudinal edge 72 of pre-pared mesh-film web 50 in a manner such that the longitudinal edge 64 (comprised of film portion 52) and longitudinal edge 72 (comprised of film portion 80) overlap one another as they exit the forming mandrel and are subsequently heat sealed to each other by the longitudinal sealing station of the machine, thus forming lap seal 152.

Figure 14:
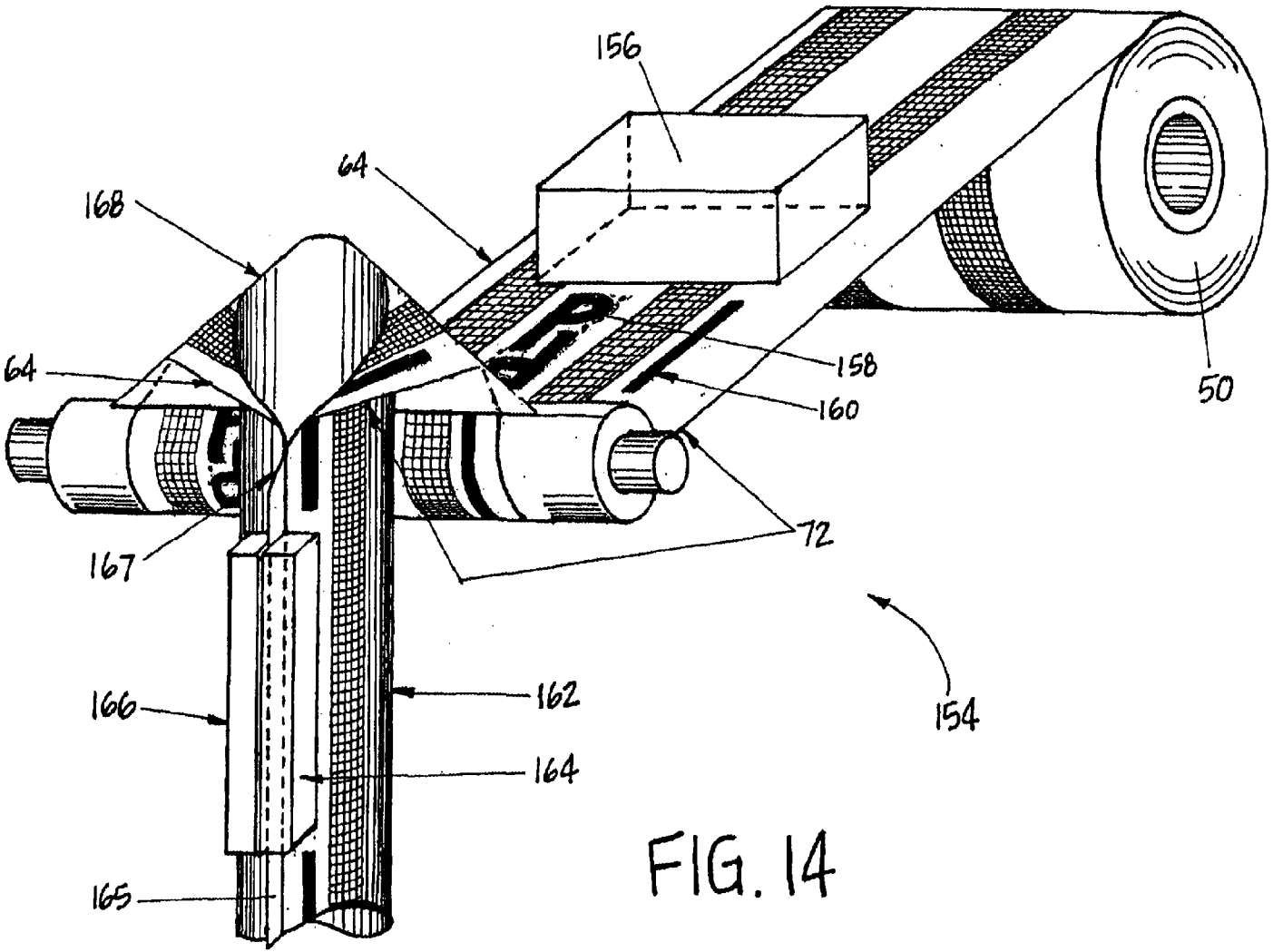
FIG. 14 is a perspective view of a vertical form, fill; and seal machine 154 processing the pre-pared mesh-film web 50 shown in FIG. 1.

FIG. 14 is a perspective view illustrating the initial processing stages of a conventional vertical form, fill, and seal machine. FIG. 14 shows pre-pared mesh-film web 50 unwinding, being printed, being formed into a tube, and advancing through a longitudinal heat-sealing station on conventional form, fill, and seal machine 154. Pre-pared mesh-film web 50 is loaded on the vertical form, fill and seal machine 154, and is intermittently pulled through the initial stages of the vertical form, fill, and seal process by pull belts (not shown) on each side of forming tube 162. In the initial stage of the vertical form, fill, and seal process, the pre-pared mesh-film web 50 is first intermittently pulled through in-line printing station 156, where it may be printed when the web is stopped. FIG. 14 shows the unprinted pre-pared mesh-film web 50 being printed at station 156 with a design pattern 158 that may include an eye-mark 160 to facilitate intermittent movement, heat sealing steps, and cut-off as the web is processed through the vertical form, fill, and seal machine.

The vertical form, fill, and seal machine operator has the flexibility to call up multiple printing programs and thus change basic bag characteristics including bag orientation such as longitudinal bag length depending on print orientation and graphic design, without having to change the pre-pared mesh-film web.

FIG. 14 shows that the next stage after printing is the forming stage. As pre-pared mesh-film web 50 (now printed) is intermittently pulled over the forming mandrel 168 and down the forming tube 162, first longitudinal edge 72 and second longitudinal edge 64 of pre-pared mesh-film web 50 are guided outward by forming mandrel 168 in a manner such that the extended longitudinal edges 64 and 72 face one another as they exit the forming mandrel 168 generally in the vicinity of arrow 167. First longitudinal sealing bar 164 is located below forming mandrel 168 and adjacent to first longitudinal edge 72 as it exits the forming mandrel in the vicinity of arrow 167. Likewise, second longitudinal sealing bar 166 is located below forming mandrel 168 and adjacent to second longitudinal edge 64 as it exits the forming mandrel, also in the vicinity of arrow 167. Longitudinal sealing bars 164 and 166 then close on first and second longitudinal edges 72 and 64 of pre-pared mesh-film web 50 to form longitudinal seal 165.

Figure 15:
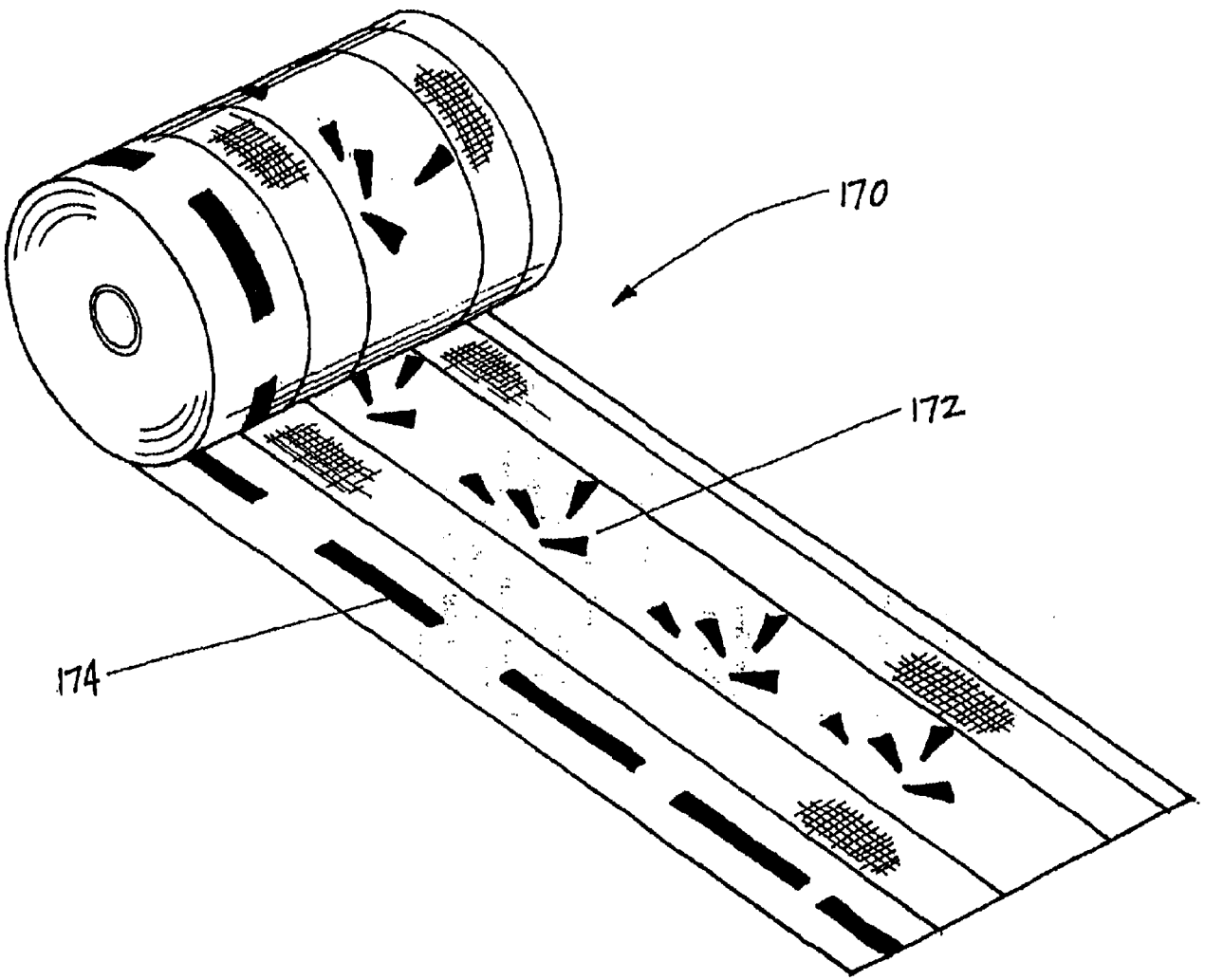
FIG. 15 is a perspective view of a printed pre-pared mesh-film web 170 for a vertical form, fill, and seal machine in accordance with the fourth embodiment of the invention; and, FIG. 16 is a schematic view from the side of a vertical form, fill, and seal machine 196 processing the printed pre-pared mesh-film web 170 shown in FIG. 15.

In accordance with the fourth embodiment of the present invention, FIG. 15 shows a perspective view of printed pre-pared mesh-film web 170 for vertical form-fill-seal packaging machines. Pre-printed pre-pared mesh-film web 170 is printed with graphics design 172 and bag cut off eye marks 174. With the exception of being pre-printed, pre-pared mesh-film web 170 is the same as unprinted pre-pared mesh-film web 50 shown in FIG. 1.

Figure 16:
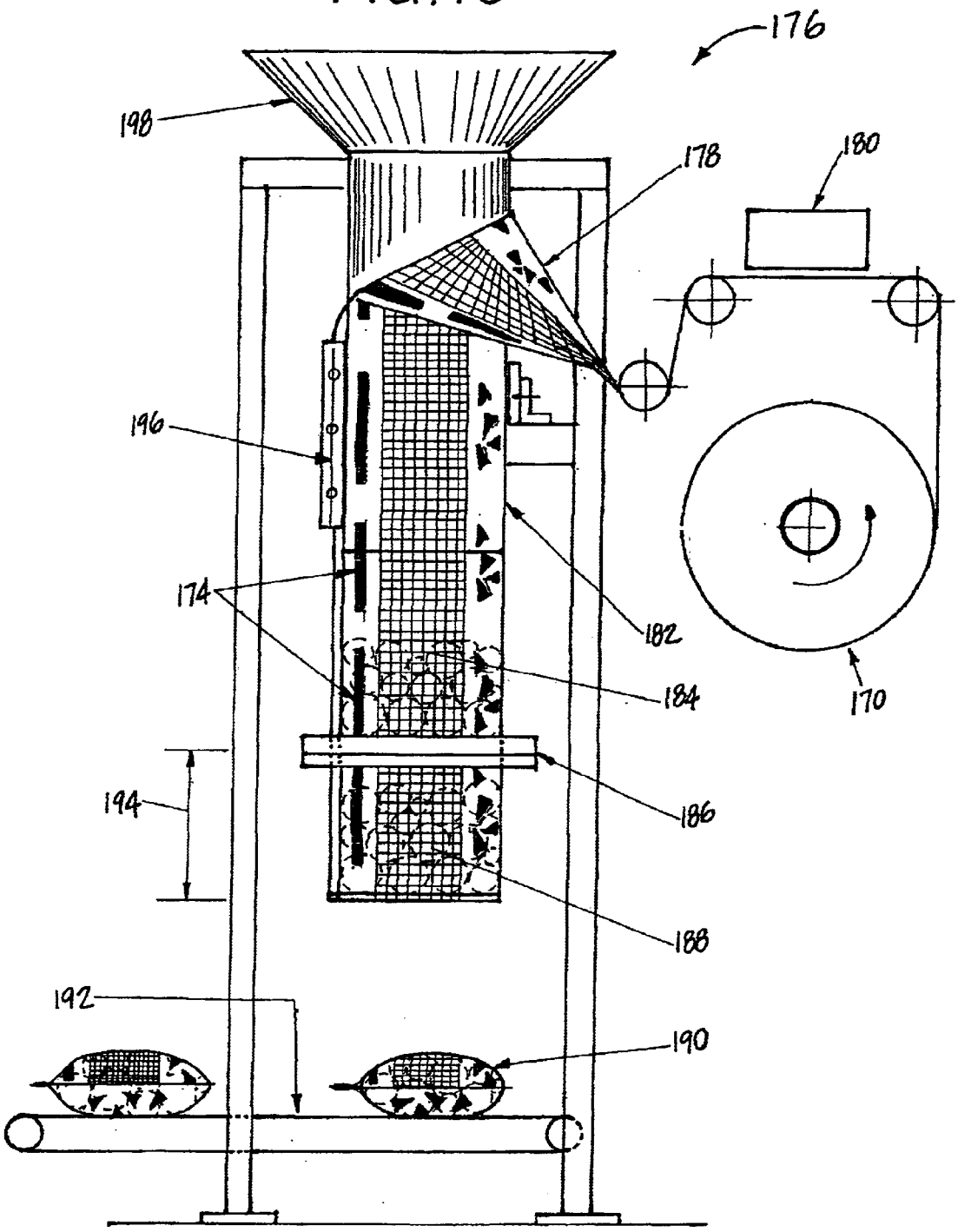

FIG. 16 is a schematic view from-the side of a conventional vertical form, fill, and seal machine 176 processing pre-printed pre-pared mesh-film web 170. Pre-printed pre-pared mesh-film web 170 intermittently advances (1) under in-line printing station 180, (2) over forming mandrel 178, (3) down forming tube 182, (4) through longitudinal heat sealing station 196, and (5) through transverse heat sealing and cut-off station 186. Forming mandrel 178 includes forming tube 182 and spout 198 through which the products are poured into the enclosed heat sealed tube of mesh-film when transverse sealing and cutting mechanism 186 is closed. When transverse heat sealing and cut-off station 186 is closed, the transverse heat sealing and cutting mechanism severs the heat sealed mesh-film tube between bag 184 being filled and previous bag 188 that has just been filled. Transverse heat sealing and cut-off station 186 clamps the mesh-film tube closed, and contemporaneously applies heat to form transverse seals for consecutive bags. Transverse heat sealing and cut-off station 186 thus applies heat to contemporaneously form the bottom transverse seal on bag 184 being filled and the top transverse seal on previous bag 188 that has just been filled. When transverse heat sealing and cut-off station 186 opens, previous bag 188 falls on to conveyor 192 in the vicinity of where bag 198 is shown. Bag 184 is then drawn downward by its own weight and the pull belts (not shown) a distance equal to dimension 194. This distance is pre-determined by the eye-marks printed on pre-pared mesh-film web 170. As bag 184 is drawn downward, when it reaches the previous position of bag 188 it is stopped while transverse heat sealing and cut-off station 186 again closes to repeat the cycle.

Referring again to FIG. 15 and FIG. 16, bag 190, is formed on vertical form, fill, and seal machine 176 using pre-printed pre-pared mesh-film web 170 shown in FIG. 15. Bag 190 has an enclosed rectangular layer of mesh-film having a longitudinal fin seal and right and left side fin seals with sufficient strength to withstand heavy-duty applications.

In a further alternate embodiment, it will be apparent to one of ordinary skill in the art that, in lieu of a three side sealed bag as described in detail hereinabove, the web of the present invention may be utilized to form a two side seal bag, the third side being closed through the use of auxiliary closure means well-known in the art. Compatible closure means may include, but are not limited to, reusable or single-use fasteners, such as wire or plastic closures.

Wire closures compatible with this invention might include by way of non-limiting example, Hamer wire ring steel closures (Hamer, Inc., Minneapolis, Minn.), or the like. Plastic closures compatible with this invention might include by way of non-limiting example, Kwik Lok® closures (Kwik Lok Corporation, Yakima, Wash.), or the like. Accordingly, when such a two side seal bag is formed from the web of the present invention, the third side of the bag is gathered following introduction of a product into the bag, and a closure means is applied about the gathered portion to define the final package.

Having thus described exemplary embodiments of the present invention, it should be noted by those skilled in the art that the within disclosures are exemplary only and that various other alternatives, adaptations, and modifications may be made within the scope of the present invention. Accordingly, the present invention is not limited to the specific embodiments as illustrated herein, but is only limited by the following claims:

We claim:

1. In an automatic form, fill and seal machine comprising:

A web source adapted to allow a continuous unprinted or printed pre-prepared mesh-film web material to dispense as a continuous longitudinal sheet;

An in-line printing station or stations that print(s) on the film surface or surfaces of the unprinted or printed pre-prepared mesh-film web;

A forming mandrel that receives the continuous pre-prepared mesh-film web from the web source and forms a tube of pre-prepared mesh-film web material, the forming mandrel having a spout that inputs items to be packaged and outputs the items into the tube of pre-prepared mesh-film web material;

A tube heat sealing mechanism that seals together portions of the continuous pre-prepared mesh-film web along longitudinal edge portions of the pre-prepared mesh-film web material to secure the mesh-film web material as a tube to form either the top and bottom or right and left sides of the package; and, A cross sealing and cutting mechanism located downstream of the forming mandrel that cuts the longitudinally sealed mesh-film tube transversely and heat seals along the transverse cut to sequentially form and seal a plurality of sealed mesh-film packages, each sealed package containing items output from the forming mandrel into the tube of mesh-film web material before the respective package is fully sealed;

A method of packaging items in a mesh-film bag comprising the steps of:

(a.) Providing a continuous pre-prepared printed or unprinted web comprising at least one thermal sealable plastic mesh portion and at least one solid plastic film portion, said mesh and film portions heat sealed in alternating longitudinal side-by-side engagement consisting, with the exception of the longitudinal heat seal between said mesh and solid film portions, of a single layer dispensed longitudinally from the web source;

(b.) Dispensing said thermal sealable pre-prepared mesh-film web from the web source and feeding said thermal sealable printed or unprinted pre-prepared mesh-film web over the forming mandrel to form a tube with longitudinal edge portions and a body portion extending between said longitudinal edge portions, said body portion comprising of said at least one mesh portion and said at least one solid plastic film portion;

(c.) Using the tube heat-sealing mechanism to seal together portions of said thermal sealable pre-prepared mesh-film web along said longitudinal edge portions to secure and form said tube;

(d.) Cross cutting and sealing said heat sealed mesh-film tube with oppositely disposed mesh and film portions contemporaneously to form a cross seal in a mesh-film package along a bottom of a package to be filled, and a cross seal along a top of a mesh-film package that was filled immediately prior to said mesh-film package to be filled; and, (e.) Placing items to be packaged through the mandrel and into said heat sealed mesh-film tube before a respective top and bottom of said mesh-film package is cross sealed to fully close said mesh-film package.

2. The method of claim 1 further comprising a step of printing said printed or unprinted mesh-film web after it is dispensed from the web source.

3. The method of claim 1 wherein said seal securing longitudinal edge portions of said pre-prepared mesh-film web forms a fin seal.

4. The method of claim 1 wherein said seal securing longitudinal edge portions of said pre-prepared mesh-film web forms a lap seal.

5. The method of claim 1 wherein the side seals formed at step (d.) are fin seals.

6. The method of claim 1 wherein thermal sealable tape is used to join longitudinal edge portions of said mesh-film web when forming said mesh-film web into a tube.

7. The method of claim 6 wherein said thermal sealable tape further comprises a zipper.

8. The method of claim 6 wherein said thermal sealable tape further comprises a handle.

9. In an automatic form, fill and seal machine comprising:

A web source adapted to allow a continuous unprinted or printed pre-prepared mesh-film web material to dispense as a continuous longitudinal sheet;

An in-line printing station or stations that print(s) on the film surface or surfaces of the unprinted or printed pre-prepared mesh-film web;

A forming mandrel that receives the continuous pre-prepared mesh-film web from the web source and forms a tube of pre-prepared mesh-film web material, the forming mandrel having a spout that inputs items to be packaged and outputs the items into the tube of pre-perpared mesh-film web material;

A tube heat sealing mechanism that seals together portions of the continuous pre-perpared mesh-film web along longitudinal edge portions of the pre-prepared mesh-film web material to secure the mesh-film web material as a tube to form either the top and bottom or right and left sides of the package; and, A cross sealing and cutting mechanism located downstream of the forming mandrel that cuts the longitudinally sealed mesh-film tube transversely and heat seals along the transverse cut to sequentially form and seal a plurality of sealed mesh-film packages, each sealed package containing items output from the forming mandrel into the tube of mesh-film web material before the respective package is fully sealed;

A method of packaging items in a mesh-film bag comprising the steps of:

(a.) Providing a continuous pre-prepared printed or unprinted web comprising at least one thermal sealable solid plastic mesh portion and at least one plastic film portion, said mesh and film portions heat sealed in alternating longitudinal side-by-side engagement consisting, with the exception of the longitudinal heat seals between said mesh and solid film portions, of a single layer dispensed longitudinally from the web source;

(b.) Dispensing said thermal sealable pre-prepared mesh-film web from the web source and feeding said thermal sealable printed or unprinted pre-prepared mesh-film web over the forming mandrel to form a tube with longitudinal edge portions and a body portion extending between said longitudinal edge portions, said body portion comprising of said at least one mesh portion and said at least one solid plastic film portion;

(c.) Sealing said longitudinal edge portions together to form said tube;

(d.) Transversely sealing said tube in at least one location to form at least one marginal edge of a package;

(e.) Placing items to be packaged through the mandrel and into said mesh-film tube; and, (f.) Transversely sealing said tube at a second location to close said package.

10. The method of claim 9 wherein said tube is closed at step (e.) by heat sealing.

11. The method of claim 9 wherein said tube is closed at step (e.) by gathering said tube and applying closure means.

12. The method of claim 11 wherein said closure means comprises a reusable or single-use fastener.

13. The method of claim 9 further comprising a step of printing said printed or unprinted mesh-film web after it is dispensed from said the web source.

14. The method of claim 9 wherein thermal sealable tape is used to join longitudinal edge portions of said mesh-film web when forming said mesh-film web into a tube.

15. The method of claim 14 wherein said thermal sealable tape further comprises a zipper.

16. The method of claim 14 wherein said thermal sealable tape further comprises a handle.

* * * * *